US008023362B2

(12) United States Patent
Suizu et al.

(10) Patent No.: US 8,023,362 B2
(45) **Date of Patent: *Sep. 20, 2011**

(54) HAND POSITION DETECTING DEVICE AND APPARATUS INCLUDING THE DEVICE

(75) Inventors: Takashi Suizu, Fussa (JP); Nobuhiro Aoki, Kokubunji (JP)

(73) Assignee: Casio Computer Co., Ltd., Tokyo (JP)

( * ) Notice: Subject to any disclaimer, the term of this patent is extended or adjusted under 35 U.S.C. 154(b) by 280 days.

This patent is subject to a terminal disclaimer.

(21) Appl. No.: 12/238,090

(22) Filed: Sep. 25, 2008

(65) Prior Publication Data

US 2009/0086581 A1 Apr. 2, 2009

(30) Foreign Application Priority Data

Sep. 28, 2007 (JP) ..... 2007-253830
Sep. 28, 2007 (JP) ..... 2007-253831

(51) Int. Cl.
*G04B 19/04* (2006.01)

(52) U.S. Cl. ..... 368/81; 368/187

(58) Field of Classification Search ..... 368/80–81, 368/187, 220–222

See application file for complete search history.

(56) References Cited

U.S. PATENT DOCUMENTS 4,358,753 A * 11/1982 Cascini ..... 341/2
4,645,357 A 2/1987 Allgaier et al.
5,457,664 A 10/1995 Izukawa et al.
5,640,007 A * 6/1997 Talbott et al. ..... 250/231.15
5,734,474 A * 3/1998 Haecker et al. ..... 356/623
5,999,495 A * 12/1999 Hashizume et al. ..... 368/80
6,288,977 B1 9/2001 Yoshida et al.
6,367,967 B1 4/2002 Kojima et al.
6,424,600 B1 7/2002 Okeya et al.
6,731,571 B2 * 5/2004 Yiu ..... 368/79
6,804,173 B2 * 10/2004 Yiu ..... 368/220
6,807,128 B2 * 10/2004 Yiu ..... 368/220
7,154,818 B2 * 12/2006 Liu ..... 368/220
2002/0167869 A1 11/2002 Masuda et al.
2004/0120220 A1 6/2004 Ogasawara
2009/0016172 A1 1/2009 Fujii et al.
2009/0086580 A1 4/2009 Aoki et al.

(Continued)

FOREIGN PATENT DOCUMENTS

EP 2042947 A1 4/2009

(Continued)

OTHER PUBLICATIONS

Translation of the detailed description of JP 2002-71847: Source: JPO website—9.ipdl.inpit.go.jp; Aug. 29, 2010.*

(Continued)

*Primary Examiner* — Sean Kayes
(74) *Attorney, Agent, or Firm* — Holtz, Holtz, Goodman & Chick, PC

(57) ABSTRACT

A detection unit detects light passing through apertures provided in a seconds wheel, a center wheel and an hour wheel, respectively, which rotate on the same axis. The apertures in the seconds wheel include a circular aperture provided at a reference position therein, and two apertures provided separated by corresponding arcuate apertures of different lengths from the aperture on its opposite sides, respectively. By counting the number of light non-detection events the detection unit encounters due to the light blocking area covering the detection unit, the rotational position of the seconds wheel is detected accurately and securely.

6 Claims, 25 Drawing Sheets

U.S. PATENT DOCUMENTS

| | | | |
|---|---|---|---|
| 2009/0086581 | A1 | 4/2009 | Suizu et al. |
| 2009/0161120 | A1 | 6/2009 | Kojima |
| 2009/0296533 | A1 | 12/2009 | Kojima |
| 2009/0296534 | A1 | 12/2009 | Kojima et al. |

FOREIGN PATENT DOCUMENTS

| | | | |
|---|---|---|---|
| GB | 2 270 398 | A | 3/1994 |
| JP | 6-222164 | A | 8/1994 |
| JP | 2000-162336 | A | 6/2000 |
| JP | 2002-71847 | A | 3/2002 |
| JP | 2002-107465 | A | 4/2002 |
| JP | 2002-116270 | A | 4/2002 |
| JP | 2002-357678 | A | 12/2002 |
| JP | 2003-194971 | A | 7/2003 |
| JP | 2004-184088 | A | 7/2004 |
| JP | 2004-257816 | A | 9/2004 |
| JP | 2006-46924 | A | 2/2006 |
| JP | 2006-153652 | A | 6/2006 |
| JP | 2006-275803 | A | 10/2006 |
| JP | 3872688 | B2 | 10/2006 |
| WO | 2007/102412 | A1 | 9/2007 |

OTHER PUBLICATIONS

Related U.S. Applications: U.S. Appl. No. 12/341,470, filed Dec. 22, 2008; U.S. Appl. No. 12/472,515, filed May 27, 2009; U.S. Appl. No. 12/473,750, filed May 28, 2009.

Japanese Office Action dated Nov. 10, 2009 and English translation thereof issued in a counterpart Japanese Application No. 2007-253830.

Extended European Search Report dated Jul. 7, 2010 (in English) issued in European Application No. 09161225.9, which is an European counterpart of *related* U.S. Appl. No. 12/473,750.

Japanese Office Action dated Mar. 16, 2010 and English translation thereof issued in Japanese Application No. 2007-331355, which is a counterpart of *related* U.S. Appl. No. 12/341,470.

Extended European Search Report dated Feb. 25, 2009 issued in counterpart European Appln. No. 08016884.2-1240.

Japanese Office Action dated Jun. 1, 2010 (and English translation thereof) issued in Japanese Application No. 2008-139127, which is a Japanese counterpart of related U.S. Appl. No. 12/472,515.

* cited by examiner

FIG.6

| 1ST DRIVING SYSTEM | | | | | |
|---|---|---|---|---|---|
| GEAR TYPE | GEAR: PINION | NUMBER OF GEAR TEETH (Z) | ROTATIONAL ANGLE | NUMBER OF PULSES REQUIRED FOR ONE ROTATION OF GEAR | DETECTION APERTURE |
| ROTOR | PINION | 10 | 180 | 2 | |
| FIFTH WHEEL | GEAR | 50 | 36 | 10 | |
| | PINION | 10 | | | |
| SECONDS WHEEL | GEAR | 60 | 6 | 60 | ● |

| 2ND DRIVING SYSTEM | | | | | |
|---|---|---|---|---|---|
| GEAR TYPE | GEAR: PINION | NUMBER OF GEAR TEETH (Z) | ROTATIONAL ANGLE | NUMBER OF PULSES REQUIRED FOR ONE ROTATION OF GEAR | DETECTION APERTURE |
| ROTOR | PINION | 10 | 180 | 2 | |
| HOUR/CENTER TRAIN GEARS | GEAR | 60 | 30 | 12 | ● |
| | PINION | 8 | | | |
| THIRD WHEEL | GEAR | 60 | 4 | 90 | |
| | PINION | 16 | | | |
| CENTER WHEEL | GEAR | 64 | 1 | 360 | ● |
| | PINION | 20 | | | |
| MINUTE WHEEL | GEAR | 60 | 1/3 | 1080 | |
| | PINION | 16 | | | |
| HOUR WHEEL | GEAR | 64 | 1/12 | 4320 | ● |

DETECTED PATTERN SECONDS WHEEL

HAND POSITION DETECTING DEVICE AND APPARATUS INCLUDING THE DEVICE

CROSS-REFERENCE TO RELATED APPLICATIONS

This application is based upon and claims the benefit of priority from the prior Japanese Patent Applications Nos. 2007-253830 and 2007-253831, filed on Sep. 28, 2007, the entire contents of which are incorporated herein by reference.

BACKGROUND OP THE INVENTION

1. Field of the Invention

The present invention relates to a hand position detecting device which detects the rotational positions of seconds, center and hour hands, for example, of a timepiece and electronic apparatus including the detecting device.

2. Description of the Related Art

In the past, a hand position detecting device which detects the rotational positions of hands of a timepiece is known, as disclosed by Japanese Published Unexamined Application 2000-162336. This device comprises a first drive system in which a first drive motor transmits its rotation to a seconds (hand) wheels which in turn causes a seconds hand to sweep around a dial, a second drive system in which a second drive motor transmits its rotation to seconds and hour wheels to cause the seconds and hour hands, respectively, to sweep around the dial. This device also includes a detector which when the seconds, center and hour wheels of the first and second drive systems are rotated on the same axis, optically detects, with the aid of a light emission element and a photodetection element included in the detector, a first, a second and a third light-passing aperture provided in the seconds, center and hour wheels, respectively, such that the respective rotational positions of the seconds, center and hour wheels and hence the seconds, center and hour hands are determined based on detected signals from the detector.

In this case, the first driving system comprises a fifth wheel with three light-passing apertures provided at angular intervals of 120 degrees for transmitting rotation of the first driving motor to the seconds wheel. This seconds wheel has eleven light-passing apertures provided at angular intervals of 30 degrees along the periphery thereof and a light blocking area provided between the first and last apertures along the periphery of the seconds wheel. Thus, when in the first driving system the fifth wheel rotates and one light-passing aperture aligns with a detection unit, the seconds wheel also rotates. Then, when its light blocking area blocks a light-passing aperture in the fifth wheel and then a first one of the apertures in the seconds wheel aligns with a light-passing aperture in the fifth wheel, thereby causing the detection unit to detect light, the seconds hand indicates a time o'clock.

An alternative to the seconds wheel has a pair of arcuate openings of predetermined lengths formed along the circumference thereof on opposite sides of a light blocking area provided at a reference position in the second wheel. The seconds wheel also has a light-passing aperture provided between the distal ends of the pair of arcuate openings in the seconds wheel from the light blocking area so as to be on the same diameter of the seconds wheel as the light blocking area. In this case, the arrangement is such that when in the first driving system the fifth wheel rotates so that one of its light-passing apertures aligns with the detection unit, the seconds wheel also rotates; its light blocking area blocks a relevant light-passing aperture in the fifth wheel; and then a part of one of the pair of arcuate openings in the second wheel following the light blocking area of the seconds wheel aligns with the light-passing opening in the fifth wheel, thereby causing the detection unit to try to detect light. When the detection unit detects light at this time, the seconds hand points to a time o'clock.

In the former first driving system employing the first-mentioned seconds wheel, when one of the three light-passing apertures provided at 120 degrees in the fifth wheel aligns with the detection unit, the rotational position of the seconds wheel is required to be detected. Thus, when the fifth and seconds wheels are assembled, both are required to be positioned accurately relative to each other, which render the assembling work complicated.

In this first driving system, a total amount of light is small which passes through the eleven light-passing apertures provided at the angular intervals of 30 degrees along the periphery of the seconds wheel. Thus, when the seconds wheel is rotated at high speeds to detect the rotational position thereof, there is a possibility that all the eleven apertures cannot be detected securely and hence the position detecting speed is limited.

In the latter first driving system employing the alternative seconds wheel, this seconds wheel has the light-passing aperture provided at the reference position in the seconds wheel and the pair of arcuate openings provided on opposite sides of the light-passing aperture. Thus, the quantity of light passing through the pair of openings is large and the rotational position of the seconds wheel can be detected at high speeds. When the light-passing aperture in the fifth wheel aligns with the detector and part of the other of the pair of openings following the light blocking area in the seconds wheel aligns with the detection position, thereby causing the detection unit to detect light, the seconds hand points to a time o'clock. Thus, even when the detection unit aligns with any point in the other opening, it is determined that the seconds hand points to a correct time o'clock. Thus, the rotational position of the seconds wheel cannot be located accurately.

SUMMARY OF THE INVENTION

It is therefore an object of the present invention to provide a hand position detecting device which detects the rotational position of the seconds wheel accurately and securely.

In order to achieve the above object, the present invention provides a hand position detecting device comprising: a first driving system in which a first driving motor transmits its rotation to a seconds wheel, which in turn drives a seconds hand; a second driving system in which a second driving motor transmits its rotation to a center wheel and an hour wheel, which in turn drive a center hand and an hour hand, respectively; the seconds, center and hour wheels being rotatably attached on the same axis; a detection unit, including light emitting means, for detecting whether light emitted by the light emitting means has passed through apertures provided in the seconds, center and hour wheels, respectively, to determine the respective rotational positions of the seconds, center and hour wheels when these wheels rotate; and the aperture in the seconds wheel comprising a circular aperture provided at a reference position in the seconds wheel, and a first and a second aperture provided spaced by a first and a second light blocking areas of different distances, respectively, in the driving and anti-driving directions of the seconds hand from the center of the circular aperture.

According to this invention, when the seconds wheel rotates and the detection unit tries to detect light, the number of times which the detection unit has detected no light may vary between the first and second light blocking areas which respectively block light passing the apertures in the seconds, center and hour wheels. Thus, by counting both the numbers of successive times which the detection unit has detected no light, the rotational position of the seconds wheel can be detected accurately and securely. For example, when the detection unit detects light passing through the aperture in the seconds wheel after the counted number of times which the detection unit has detected no light due to the second light blocking area blocking light passing through the apertures in the seconds, center and hour wheels has reached a predetermined number, it is determined that the reference position in the seconds wheel is detected. Thus, the rotational position of the seconds wheel can be detected accurately and securely.

In order to achieve the above object, the present invention also provides a hand position detecting device comprising: a seconds wheel having an aperture provided at a reference position therein, and two arcuate apertures provided spaced by a first blocking area and a second light blocking area of different lengths, respectively, on opposite sides of the center of the aperture provided at the reference position therein; a center wheel disposed on the same axis as the seconds wheel and having an aperture; an hour wheel disposed on the same axis as the seconds and center wheels and having a plurality of apertures; aperture detecting means, including light emitting means, for detecting whether light emitted by the light emitting means has passed through the apertures to determine the respective rotational positions of the seconds, center and hour wheels; and seconds hand reference position detecting means for determining, when the number of successive times which the aperture detecting means has detected no light due to rotation of the seconds wheel is a predetermined number and then the aperture detecting means detects light, emitted by the light emitting means, due to subsequent rotation of the seconds wheel in a next unit of a predetermined rotational angle, as the reference position in the seconds wheel the position of the aperture in the seconds wheel through which the aperture detecting means detected light.

According to this invention, when the seconds wheel rotates at a predetermined rotational angle unit such that the number of successive times which the aperture detecting means has detected no light reaches the predetermined number and then the aperture detecting means detects light through the aperture in the seconds wheel in the next unit of a predetermined rotational angle, the position of this aperture in the seconds wheel is determined as the reference position in the seconds wheel. Thus, the rotational position of the seconds wheel is detected accurately and securely.

BRIEF DESCRIPTION OF THE DRAWINGS

The accompanying drawings, which are incorporated in and constitute a part of the specification, illustrate presently preferred embodiments of the present invention and, together with the general description given above and the detailed description of the preferred embodiments given below, serve to explain the principles of the present invention in which:

FIG. 6 shows details of components of each of first and second driving systems, the operational conditions of the components, etc.

FIGS. 11A, 11B, 11C, 11D, 11E, 11F, 11G, 11H, 11I, 11J, 11K, 11L, 11M, 11N, 11O and 11P show a basic position detecting operation of the seconds, hour and intermediate wheels of FIG. 5 wherein FIGS. 11A, 11B, 11C, 11D, 11E, 11F, 11G, 11H, 11I, 11J, 11K, 11L and 11M illustrate the respective states of these wheels obtained when the center wheel is rotated sequentially one step (or twelve degrees) at a time; FIG. 11N shows the state of these wheels when the center wheel is rotated 360 steps or one hour from the state of FIG. 11M; FIG. 11O shows the state of these wheels obtained when the center wheel is rotated 9 hours from the state of FIG. 11N; and FIG. 11P shows the state of these wheels at an "11-o'clock 00-minute position" obtained when the center wheel is rotated one hour from the state of FIG. 11O.

DETAILED DESCRIPTION OF THE INVENTION

Figure 1:
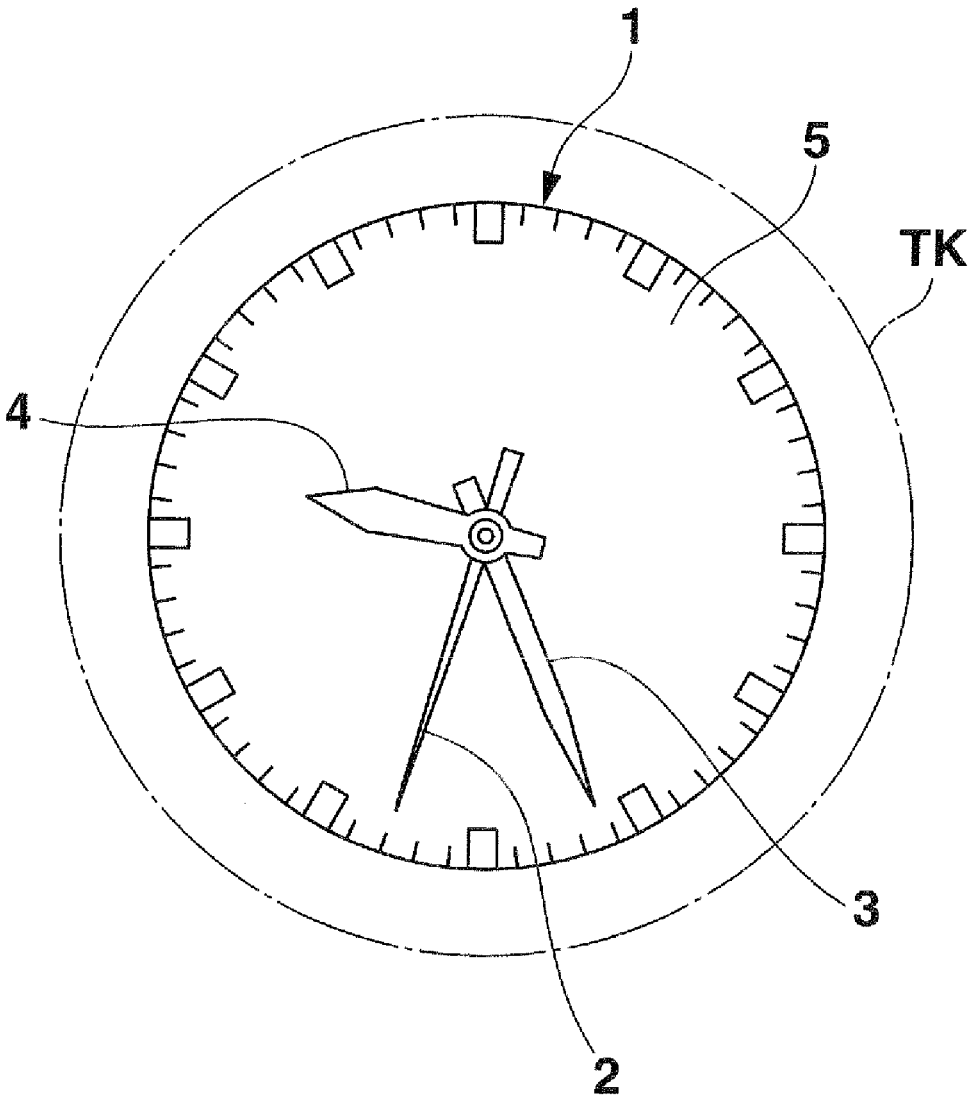
FIG. 1 is a plan view of a watch module of a hand type wristwatch according to one embodiment of the present invention.

Referring to FIGS. 1 to 23, description will be made of a hand type wristwatch according to one embodiment of the present invention. This wristwatch comprises a watch module 1 of FIGS. 1 and 2, which in turn comprises a seconds hand 2, a center hand 3 and an hour hand 4 which sweep around a dial 5 to indicate time and is encased within a case TK with glass G on top of the case and with a case back UB.

Figure 2:
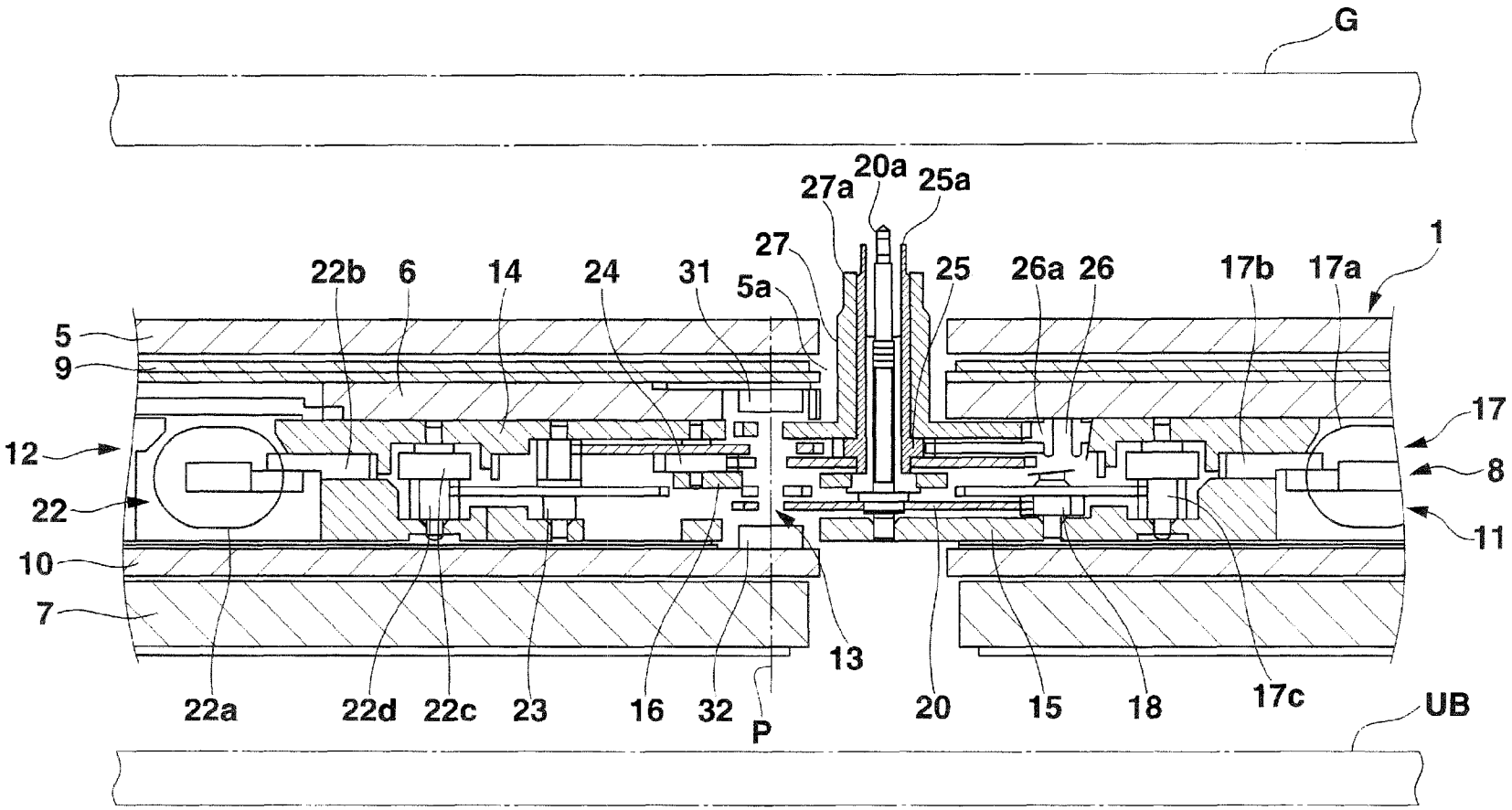
FIG. 2 is an enlarged cross-sectional view of an essential portion of the watch module of FIG. 1.
Figure 3A:
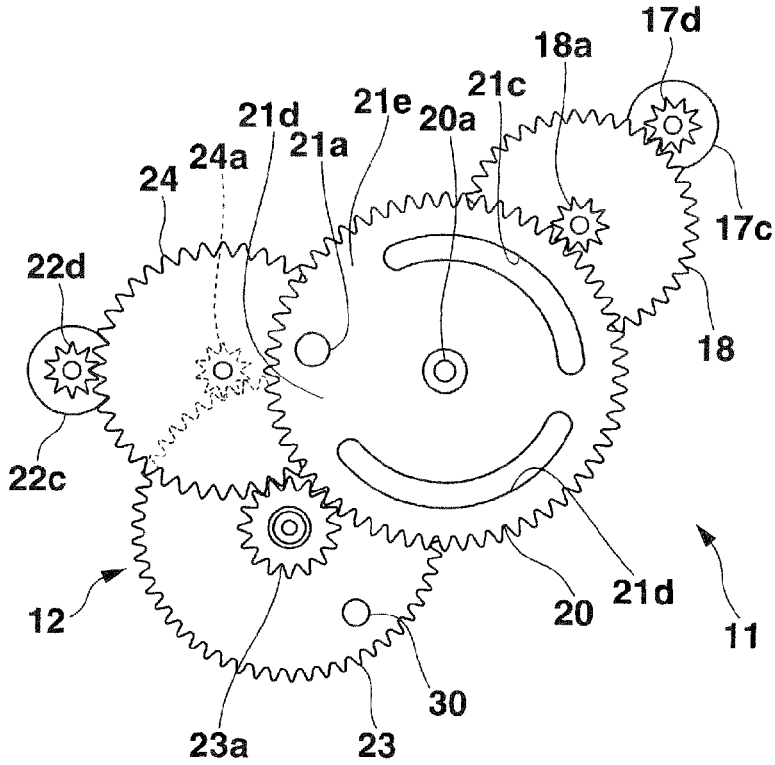
FIG. 3A is an enlarged bottom view of an essential portion of a watch movement of FIG. 2, and FIG. 3B schematically illustrates the watch movement.
Figure 3B:
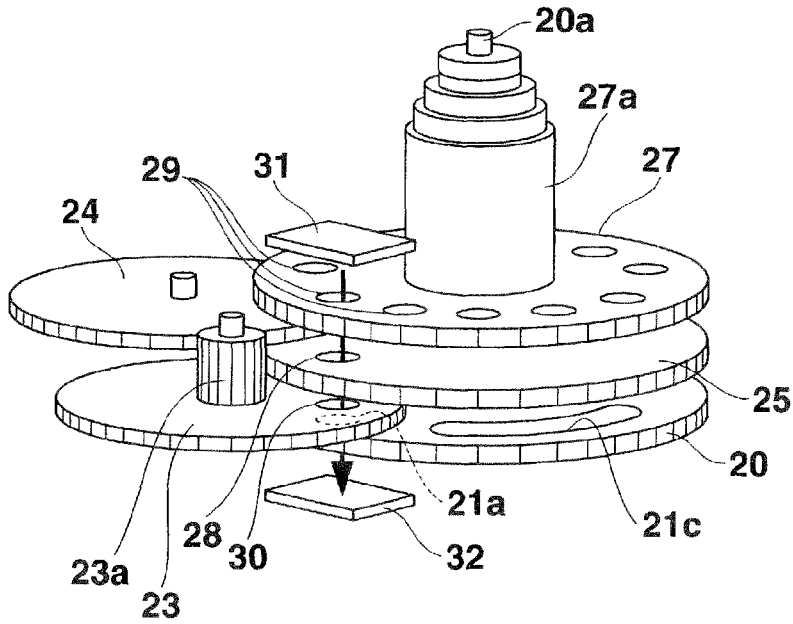

As shown in FIG. 2, the watch module 1 has an upper housing 6 and a lower housing 7 between which a watch movement 8 is provided. The dial 5 is provided on top of the upper housing 6 through a solar panel 9. A circuit hoard 10 is provided within the lower housing 7.

As shown in FIGS. 2, 3A, 3B and 4, the watch movement 8 comprises a first driving system 11 which drives the seconds hand 2 and a second driving system 12 which drives the center and hour hands 3 and 4, and a detection unit 13 that detects the rotational positions of the seconds, center and hour hands 2, 3 and 4. The first and second driving systems 11 and 12 are attached to a main plate 14, a train wheel bridge 15 and a center wheel bridge 16 between the upper and lower housings 6 and 7.

Figure 4:
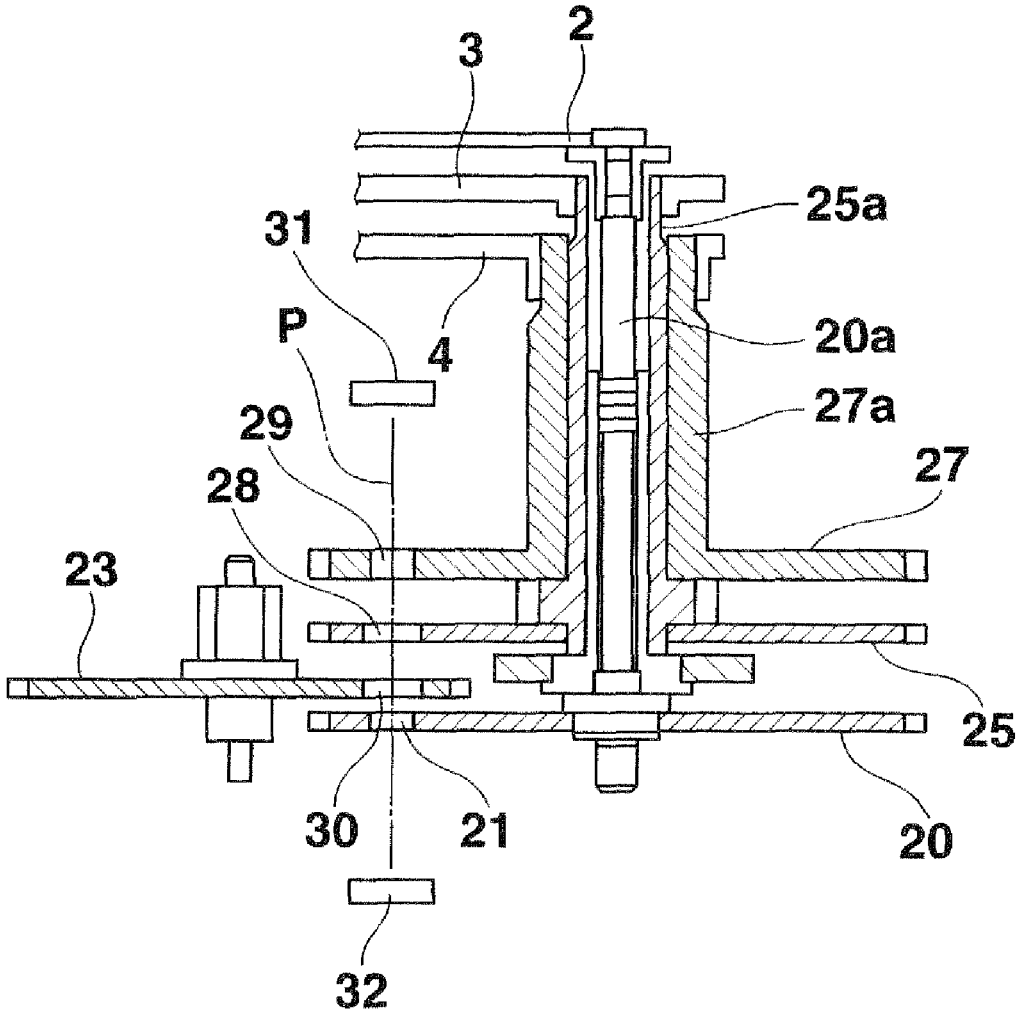
FIG. 4 is an enlarged cross-section view of an essential portion of FIG. 2.

As shown in FIGS. 2 to 4, the first driving system 11 comprises a first stepping motor 17, a fifth wheel 18 rotated by the first stepping motor 17, a fourth or seconds (hand) wheel 20 which is rotated by the fifth wheel 18. The seconds hand 2 is attached to a seconds hand shaft 20*a* (FIG. 4). As shown in FIG. 2, the first stepping motor 17 comprises a coil block 17*a*, a stator 17*b* and a rotor 17*c*. When a required current flows through the coil block 17*a*, a magnetic field will be produced, thereby rotating the rotor 17*c* 180 degrees at a time.

Figure 5:
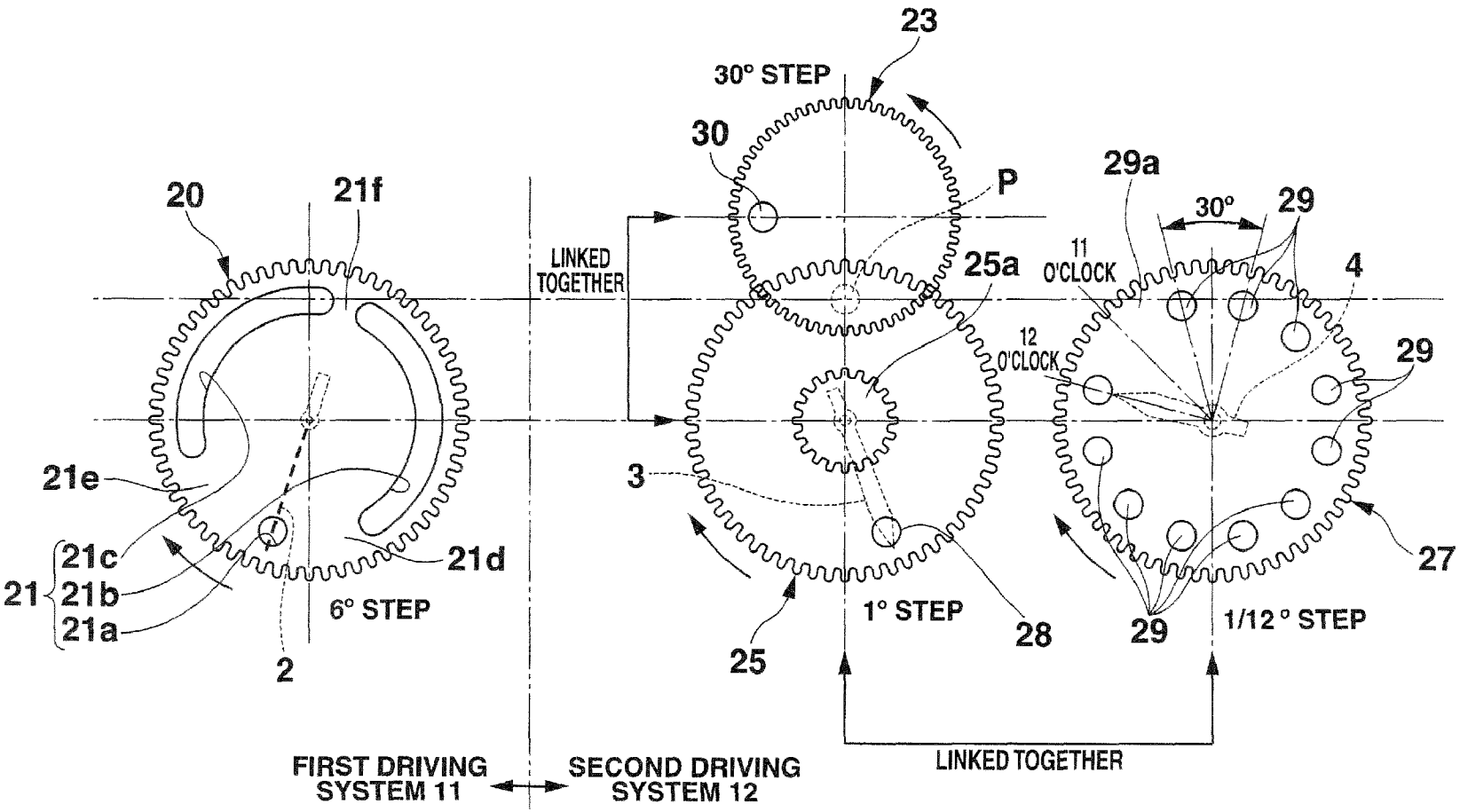
FIG. 5 is an enlarged exploded plan view of an assembly of a seconds, a center and an hour (hand) wheel of FIG. 3.
Figure 7:
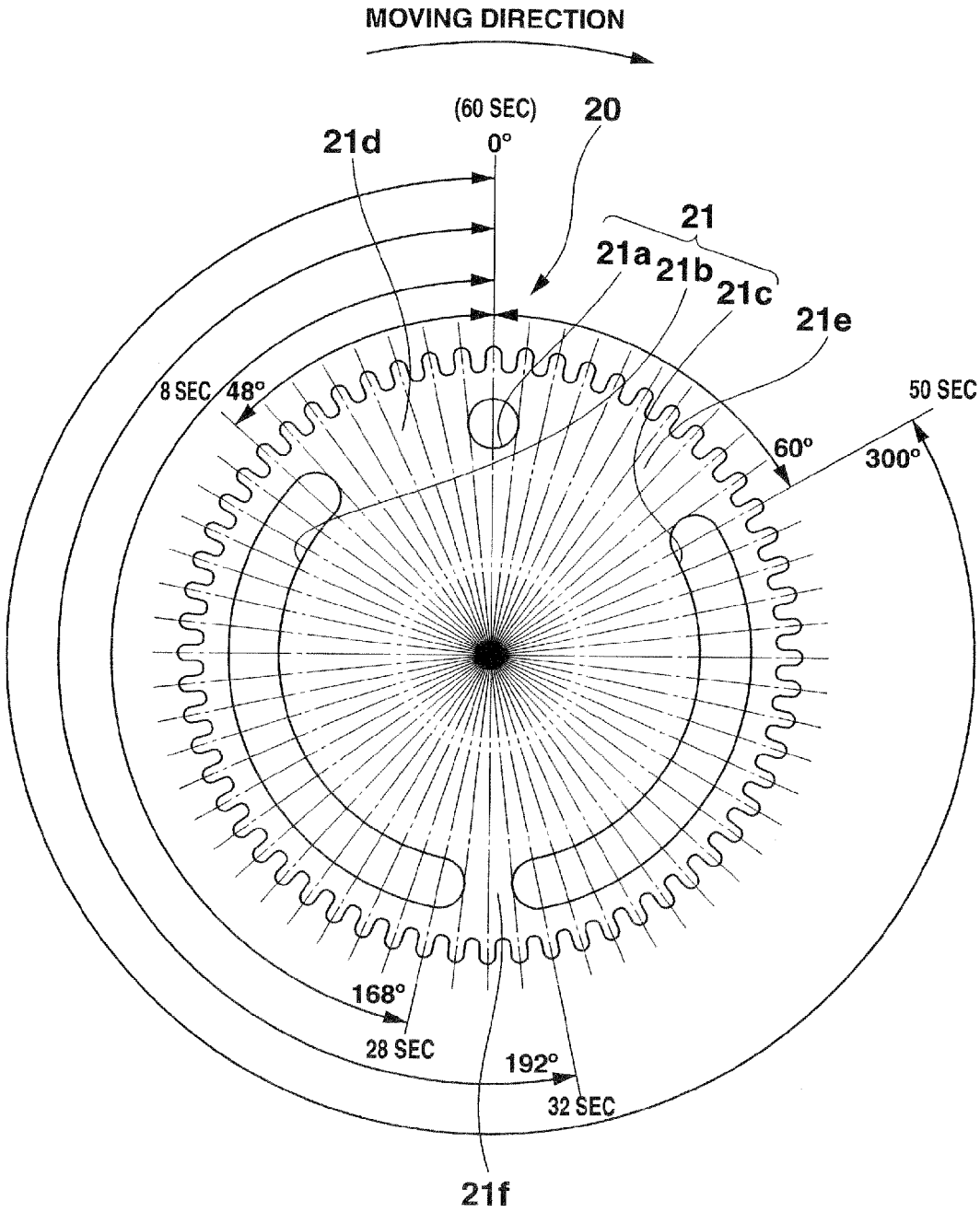
FIG. 7 is an enlarged plan view of the seconds wheel of FIG. 5.

As shown in FIGS. 2 and 3, the fifth wheel 18 rotates, meshing with a pinion 17*d* of the rotor 17*c* of the first stepping motor 17. The seconds wheel 20 rotates, meshing with a pinion 18*a* of the fifth wheel 18. As shown in FIG. 2, a seconds hand shaft 20*a* extends upward through aligned apertures 5*a* in the seconds wheel 20, upper housing 6, solar panel 9 and dial 5. As shown in FIG. 4, the seconds hand 2 is attached to a top of the seconds hand shaft 20*a*. As shown in FIGS. 5 and 7, the seconds wheel 20 has three different light-passing apertures 21*a*, 21*b* and 21*c* (For brevity of explanation, any of these apertures 21*a*, 21*b* and 21*c* can be described merely as 20).

As shown in FIGS. 2 to 5, the second driving system 12 comprises a second stepping motor 22, an intermediate wheel 23 which is rotated by the second stepping motor 22, a third wheel 24 which is rotated by the intermediated wheel 23, a second or center (hand) wheel 25 rotated by the third wheel 24, a minute wheel 26 which is rotated by the center wheel 25, and an hour (hand) wheel 27 which is rotated by the minute wheel 26. The center hand 3 is attached to a shaft 25*a* of the center wheel 25 and the hour hand 4 to a shaft 27*a* of the hour wheel 27.

As shown in FIG. 2, the second stepping motor 22 comprises a coil block 22*a*, a stator 22*b* and a rotor 22*c*. When a required current flows through the coil block 22*a*, a magnetic field will be produced, thereby rotating the rotor 22*c* by 180 degrees at a time. As shown in FIGS. 2 and 3, the intermediate wheel 23 rotates, meshing with a pinion 22*d* of the second stepping motor rotor 22*c*. As shown in FIG. 5, the intermediate wheel 23 has a circular light-passing aperture 30. The third wheel 24 rotates, meshing with a pinion 23*a* of the intermediate wheel 23 while the center wheel 25 rotates, meshing with a pinion 24*a* of the third wheel 24.

As shown in FIGS. 2 and 4, the center wheel 25 has at its center an upright hollow cylindrical shaft 25*a* through which a shaft 20*a* of the seconds wheel 20 extends rotatably. As shown in FIG. 2, the center hand shaft 25*a* extends upward through common apertures 5*a* provided in the upper housing 6, solar panel 9 and dial 5. As shown in FIG. 4, the center hand 3 is attached to the center hand shaft 25*a* such that the center wheel 25 is disposed on the same axis as the seconds wheel 20 above the same. As shown in FIG. 5, the center wheel 25 has a light-passing aperture 28.

As shown in FIG. 2, the minute wheel 26 rotates, meshing with a pinion 25*a* of the center wheel 25. The hour wheel 27 rotates, meshing with a pinion 26*a* of the minute wheel 26. The hour wheel 27 has at its center an upward protruding hollow cylindrical shaft 27*a* through which the shaft 25*a* of the center wheel 25 in turn extends rotatably. As shown in FIG. 2, the hour hand shaft 27*a* extends upward through the apertures 5*a* provided in the upper housing 6, solar panel 9 and dial 5. As shown in FIG. 4, the hour hand 4 is attached to top of the hour hand shaft 27*a* such that the hour wheel 27 is disposed on the same axis as the center wheel 25. As shown in FIG. 5, the hour wheel 27 has a plurality of circular light-passing apertures 29 provided at predetermined intervals along the periphery thereof.

FIG. 6 shows details of components of each of the first and second driving systems 11 and 12, the drive conditions of the components, etc. The rotor pinion 17*d* of the first driving system 17 rotates 180 degrees or one step per pulse. The fifth wheel 18 rotates 36 degrees per pulse (or per step of the rotor 17*c* rotation). The seconds wheel 20 rotates 6 degree per pulse (or per step of the rotor 17*c* rotation) and hence makes one rotation with 60 pulses (or in 60 steps of the rotor 17*c* rotation).

The pinion 22*d* of the rotor 22 of the second driving system 12 rotates 180 degrees or one step per pulse. The intermediate wheel 23 rotates 30 degrees per pulse (or per step of the rotor 22*c* rotation), thereby making one rotation with 12 pulses (in 12 steps of the rotor 22*c* rotation). The third wheel 24 rotates 4 degrees per pulse (or per step of the rotor 22*c* rotation). The center wheel 25 rotates one degree per pulse (or per step of the rotor 22*c* rotation), and makes one rotation with 360 pulses (in 360 steps of the rotor 22*c* rotation). The minute wheel 26 rotates ⅓ degrees per pulse (per step of the rotor 22*c* rotation).

The hour wheel 27 rotates 1/12 degrees per pulse (per step of the rotor 22*c* rotation) and hence makes one rotation with 4320 pulses (in 4320 steps of the rotor 22*c* rotation).

As shown in FIG. 2, the detection unit 13 comprises a light emission element 31, which includes a light emitting diode, and a photodetection element 32, which includes a phototransistor. The light emission element 31 and the photodetection element 32 are attached to the upper housing 6 and the circuit board 10, respectively. The arrangement is such that when one of the light-passing apertures 21*a*, 21*b* and 21*c* in the seconds wheel 20; the aperture 28 in the center 25; one of the apertures 29 in the hour wheel 27; and the aperture 30 in the intermediate wheel 23 align wholly or partially with an optical path or detection position P, which is set at an 0-o'clock 00-minute 00-second position in this embodiment, between the light emission and detection elements 31 and 32, the photodetection element 32 detects light from the light emission element 31 through those apertures, thereby detecting the respective rotational positions of the seconds, center and hour wheels 20, 25 and 27. The position of the optical path or detection position P is not limited to the specified example, but may be another position such as, for example, an 11-hour 55-minute position.

As shown in FIG. 7, in the seconds wheel 20 the aperture 21*a* is provided as a circular one at a reference or 00-second position in the seconds wheel 20, and the apertures 21*b* and 21*c* are provided as arcuate ones on the opposite sides of the circular aperture 21*a* along the periphery of the seconds wheel 20 so as to be spaced by first and second light blocking areas 21*d* and 21*e* of different lengths, respectively, from the circular aperture 21*a*. A third light blocking area 21*f* formed between the arcuate apertures 21*b* and 21*c* is on the same diameter of the seconds wheel 20 as the circular aperture 21*a*.

Figure 23:
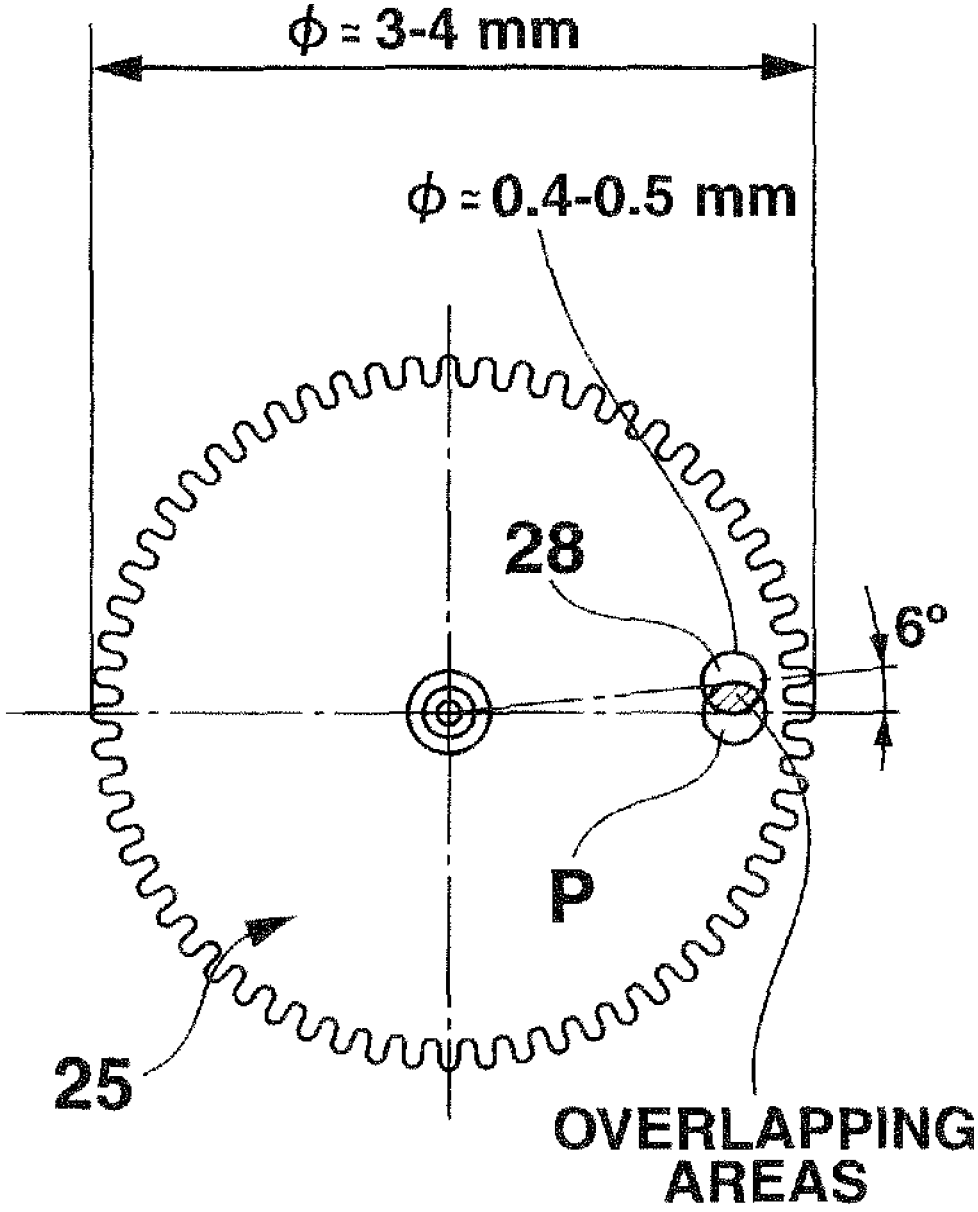
FIG. 23 is an enlarged plan view of the center wheel, indicating an amount of movement of a light-passing aperture in the center wheel relative to the detection potion in the detection unit when the center wheel of FIG. 5 rotates one step or degree at a time.

As shown in FIGS. 7 and 23, the seconds wheel 20 has a diameter of approximately 3-4 mm. Its circular aperture 21*a* has a diameter of approximately 0.4-0.5 mm or approximately 12 degrees indicative of an angle of the circular aperture 21*a*, as viewed from the center of the seconds wheel 20. As shown in FIG. 7, the first arcuate aperture 21*b* extends between an approximately 48° or 8-second position and an approximately 168° or 28-second position in a counterclockwise direction from the circular aperture 21*a* on the circumference of the same circle, or same locus of rotation, as the circular aperture 21*a*. As shown in FIG. 7, the second arcuate aperture 21*c* extends between an approximately 192° or 32-second position and an approximately 300° or 50-second position in the counterclockwise direction from the center of the aperture 21*a* on the same locus of rotation as the circular aperture 21*a*.

As shown in FIG. 7, the first light blocking area 21*d* present in the counterclockwise direction from the reference or 0° position which is the center of the circular aperture 21*a* extends through an angular extent which is approximately three times twelve degrees indicative of the angle of the circular aperture 21*a*, as viewed from the center of the seconds wheel 20, or a net angular extent of approximately 36 degrees between the reference or 0° position which is the center of the circular aperture 21*a* and an approximately 48° or 8-second position as viewed in the counterclockwise direction.

The second light blocking area 21*e* is longer by an angular extent corresponding to approximately the angle of the circular aperture 21*a* as viewed from the center of the seconds wheel 20 than the first light blocking area 21*d*. That is, the second light blocking area 21*e* extends through an angular extent of approximately 4 times the angle of the circular aperture 21*a* as viewed from the center of the seconds wheel 20, or through a net angular extent of approximately 48 degrees from the center of the circular aperture 21*a* (or the reference or 0-degree position) to an approximately 60 degree or 50-second position in the clockwise direction. As shown in FIG. 7, the third light blocking area 21*f* is provided between the arcuate aperture 21*b* and 21*c* and has an angular extent of substantially the angle of the circular aperture 21*a*, as viewed from the center of the seconds wheel 20. The third light blocking area 21*f* is also on the same diameter of the seconds wheel 20 as the aperture 21*a*.

The first light blocking area 21*d* is the same diameter of the seconds wheel 20 as part of the arcuate aperture 21*c*. The second light blocking area 21*e* is on the same diameter of the seconds wheel 20 as part of the arcuate aperture 21*b*. As described above, the third blocking area 21*f* is on the same diameter of the seconds wheel 20 as the circular aperture 21*a*. Thus, when the seconds wheel 20 rotates clockwise 180 degrees (or half rotation) from the state in which any one of the first-third tight blocking areas 21*d* to 21*f* has blocked the detection position P in the detection unit 13 where the light emission element 31 faces the photodetection element 32, any of the circular and arcuate apertures 21*a*, 21*b* and 21*c* is arranged to align wholly or partially with the detection position P necessarily. In the description, when the rotating directions of the seconds, center and hour wheels 20, 25 and 27 are not specified, they should be rotated clockwise around their respective rotational axes, as shown by arrows in the respective FIGS. 5 and 10A to 15F, and at this time the rotating direction of the intermediate wheel 23 should be counterclockwise.

Figure 8:
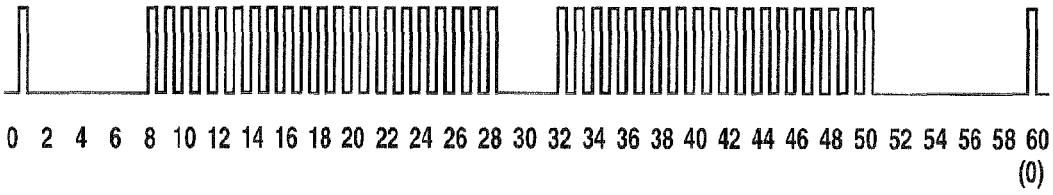
FIG. 8 is a detected pattern of the seconds wheel detected by a detection unit.

While the seconds wheel 20 rotates around a center axis thereof 2 steps, 12 degrees or 2 seconds at a time until it rotates 60 steps, 360 degrees or 60 seconds in total, the detection unit 13 detects light or apertures at intervals of 2 seconds, thereby producing a detected pattern shown in FIG. 8. More particularly, when the seconds wheel 20 is at the position of 0 seconds or degrees, the detection unit 13 detects the circular aperture 21*a*. When the seconds wheel 20 rotates from a 2-second position or 12° position to a 6-second position or 36° position, the first light blocking area 21*d* blocks the detection position P or light path in the detection unit 13, and hence three non-detection events where the detection unit 13 cannot detect light occur successively.

When the seconds wheel 20 rotates from an 8-second or 48° position to a 28-second or 168° position, the detection unit 13 detects light or the arcuate aperture 21*b* continuously. When the seconds wheel 20 is at a 30-second or 180° position, the third light blocking area 21*f* blocks the detection position P, and hence the detection unit 13 cannot detect apertures. When the seconds wheel 20 is between a 32-second or 192° position and a 50-second or 300° position, the detection unit 13 detects light or the arcuate aperture 21*b* continuously. When the seconds wheel 20 is between at a 52-second or 312° position and a 58-second or 348° position, the light blocking area 21*e* has blocked the detection position P, and hence four non-detection events occur successively to the detection unit 13.

Figure 9:
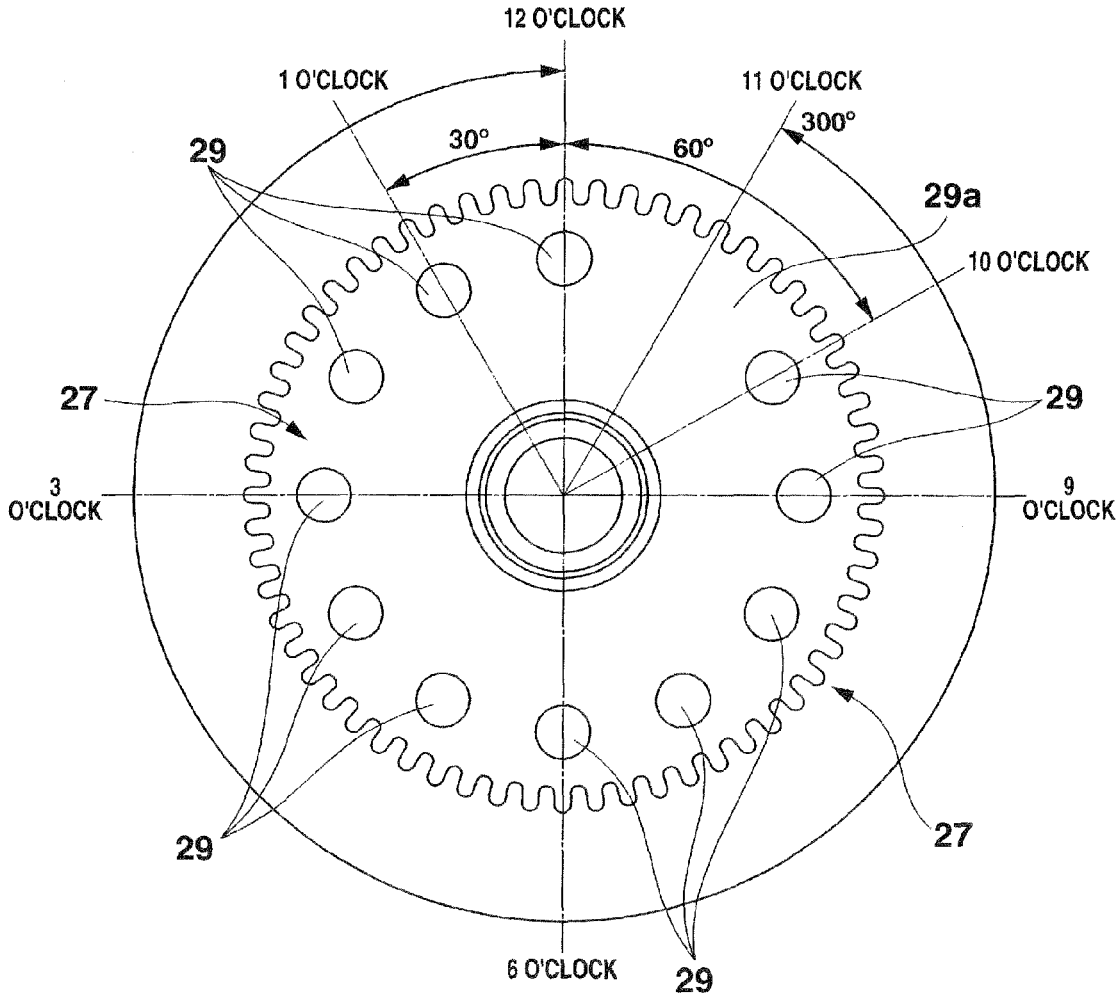
FIG. 9 is an enlarged plan view of the hour wheel of FIG. 5.

As shown by a solid line in FIG. 5, the aperture 28 in the center wheel 25 is a circular one provided at a reference or 00-minute or 0° position in the center wheel 25. The aperture 28 has substantially the same size as the circular one 21*a* in the seconds wheel 20 and is provided on the circumference of the same circle as the circular aperture 21*a* in the seconds wheel 20. As shown in FIGS. 5 and 9 and mentioned above, the hour wheel 27 has the eleven circular light-passing apertures 29 arranged at angular intervals of 30° along the periphery thereof, starting at a reference, 00-o'clock or 0° position therein. A light blocking area 29*a* is provided in the hour wheel 27 between the aperture at the reference position and the eleventh aperture (i.e. at the one o'clock position in FIG. 9).

As shown in FIG. 9, the apertures 29 in the hour wheel 27 are provided at respective angular positions of 0, 30, 60, 90, 120, 150, 180, 210, 240, 270 and 300° in the counterclockwise direction or at positions of 0, 1, 2, 3, 4, 5, 6, 7, 8, 9 and 10 o'clock with a 00-o'clock or 0° position as a reference position in the hour wheel 27 in the clockwise direction (in FIG. 9, in the counterclockwise direction). The fourth light blocking area 29*a* is provided at an 11 o'clock position (or a one o'clock position in FIG. 9). These circular apertures 29 in the hour wheel 27 have substantially the same size as the aperture 21*a* in the seconds wheel 20.

As shown in FIG. 5, the aperture 30 in the intermediate wheel 23 can align with the aperture 28 in the center wheel 25 and has substantially the same size as the apertures 21*a* and 28 in the seconds and center wheels 20 and 25. The aperture 30 is provided at such a position in the intermediate wheel 23 that when the aperture 28 in the center wheel 25 aligns with the detection position P, the aperture 30 aligns with the aperture 28 in the center wheel 25.

The detection unit 13 tries to detect light at each of the 0, 1, 2, . . . and 11 o'clock. The intermediate, center and hour wheels 23, 25 and 27 of the second driving system 12 rotate 30, 1 and (1/12)°, respectively, in one step or a half rotation of the rotor 22*c*. Thus, as shown in FIG. 5, the arrangement is such that at each of the time o'clock excluding the 11 o'clock, the apertures 28 and 30 in the center and intermediate wheels 25 and 23 and one of the apertures 29 in the hour wheel 27 align all with the detection position P.

The seconds wheel 20 of the first driving system 11 rotates 6 degrees (or a half rotation of the rotor 17*c*) per step. Each time the seconds wheel 20 rotates 60 steps or seconds, its aperture 21*a* aligns with the detection position P. Thus, as shown in FIG. 5, each time the hour hand 4 indicates a respective one of 0-10 o'clock, the aperture 21*a* aligns with the apertures 28, 30 and a relevant one of the apertures 29.

The detection units 13 detects the driving positions of the seconds, center and hour hands 2, 3 and 4 as follows: when the seconds, center and hour hands 2, 3 and 4 coincides at the 12 o'clock position (the top position in FIG. 5), a relevant one of the apertures 21*a*, 21*b* and 21*c* in the seconds wheel 20, the aperture 28 in the center wheel 25, a relevant one of the apertures 29 in the hour wheel 27 and an intermediate wheel 23 align wholly or partially with the detection position P in FIG. 5 and a light beam from the light emission element 31 should be detected through these apertures by the photodetection element 32.

Since the light beam from the light emission element 31 is blocked when any of those apertures is offset from the detection position P, no light beam from the light emission element 31 is detected by the photodetection element 32.

By reversing 180° degrees rotations of the respective rotors 17*c* and 22*c* of the first and second stepping motors 17 and 22, the respective seconds, center and hour hands 2, 3 and 4 are driven one step. To this end, pulses of opposite polarities are applied alternately to each of the stepping motors 17 and 22 at every step, thereby rotating the rotors 17*c* and 22*c*. Thus, even when pulses of the same polarity are applied successively to a respective one of the stepping motors 17 and 22, the respective rotors 17*c* and 22*c* do not rotate and remain stopped.

In the first stepping motor 17 of the first driving system 11, unless the seconds wheel 20 rotates two steps, its circular aperture 21*a* does not completely move away from the detection position P due to a relationship between the size of the aperture 21*a* and a moving quantity per step of the seconds wheel 20 rotation. Thus, with the seconds wheel 20, the detection unit 13 tries to detect light at every two steps (or seconds) of the seconds wheel 20 rotation. With the intermediate, center and hour wheels 23, 25 and 27 of the second driving system 12, the detection unit 13 tries to detect light at each step of rotation of each of these wheels.

Then, referring to FIGS. 10A, 10B, 10C, 10D, 10E, 10F, 10G, 10H, 10I, 10J, 10K, 10L and 10M, description will be made of a basic seconds hand position detecting method for detecting a reference or 00-second position in the seconds wheel 20. In this process, the minute, hour and intermediate wheels 25, 27 and 23 of the second driving system 12 should be neglected. FIGS. 10A, 10B, 10C, 10D, 10E, 10F, 10G, 10H, 10I, 10J, 10K, 10L and 10M each show a relationship between the detection position P of the detection unit 13 and a rotational angular position of the seconds wheel 20 when the same rotates two steps (or a rotational angle of twelve degrees) at a time.

Figure 10A:
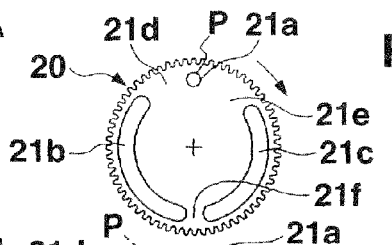
FIGS. 10A, 10B, 10C, 10D, 10E, 10F, 10G, 10H, 10I, 10J, 10K, 10L and 10M show a basic position detecting operation of the seconds wheel of FIG. 7, each (excluding FIG. 10A) illustrating a respective state of the seconds wheel rotated two steps or 12° at a time from a detection point P.

The basic method is achieved by detecting the reference or 00-second position in the seconds wheel 20 of FIG. 10A where the aperture 21*a* in the seconds wheel 20 aligns with the detection position P. In this state, the detection unit 13 can detect light.

Figure 10B:
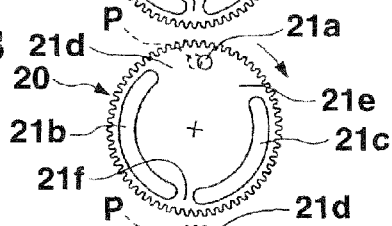
Figure 10C:
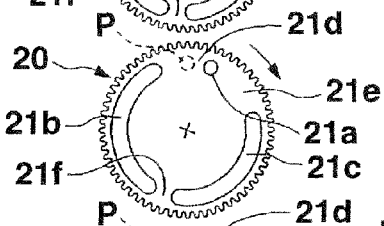
Figure 10D:
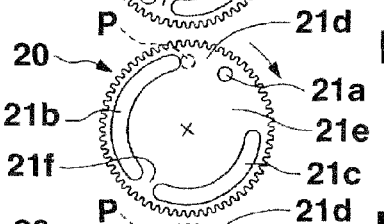

First, when the seconds wheel 20 rotates clockwise two steps from the state of FIG. 10A until its total rotational angle is twelve degrees, the aperture 21*a* in the seconds wheel 20 moves clockwise away from the detection position P and the first light blocking area 21*d* covers the detection position P, as shown in FIG. 10B. Thus, the detection unit 13 cannot detect light, as shown at a 2-second position in FIG. 8. Likewise, as shown in FIGS. 10C and 10D, until the seconds wheel 20 rotates 2 steps at a time until its total rotational angle is 36 degrees, the third light blocking area 21*d* blocks the detection position P. Thus, the detection unit 13 cannot detect light and three non-detection events occur successively, as shown at 3 to 6 second positions in FIG. 8.

Figure 10E:
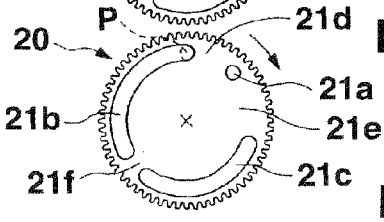
Figure 10F:
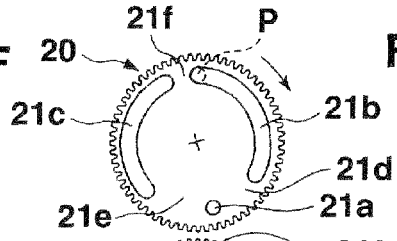

Then, as shown in FIG. 10E, when the seconds wheel 20 further rotates two steps until its total rotational angle is 48 degrees, the arcuate aperture 21*b* in the seconds wheel 20 aligns partially with the detection position P. Thus, as shown at an 8-second position in FIG. 8, the detection unit 13 can detect light. Similarly, as shown in FIG. 10F, when the seconds wheel 20 then rotates two steps at a time until its total rotational angle is 168 degrees, the arcuate aperture 21*b* in the seconds wheel 20 aligns partially with the detection position P. Thus, the detection unit 13 can detect light continuously, as shown at 10- to 28-second positions in FIG. 8.

Figure 10G:
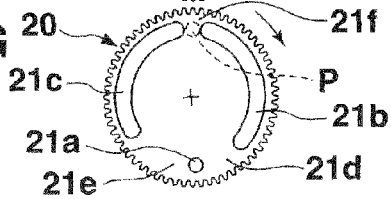
Figure 10H:
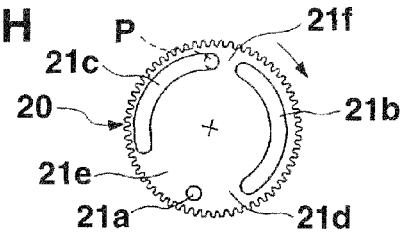

As shown FIG. 10G, when the seconds wheel 20 further rotates two steps until its total rotational angle is 180 degrees, its arcuate aperture 21*b* moves clockwise from the detection position P and the third light blocking area 21*f* covers the detection position P. Thus, the detection unit 13 cannot detect light, as shown at a 30-second position in FIG. 8. Then, as shown in FIG. 10H, when the seconds wheel 20 further rotates two steps until its total rotational angle is 192 degrees, the arcuate aperture 21*c* in the seconds wheel 20 aligns partially with the detection position P. Thus, as shown at a 32-seconds position in FIG. 8, the detection unit 13 can detect light.

Figure 10I:
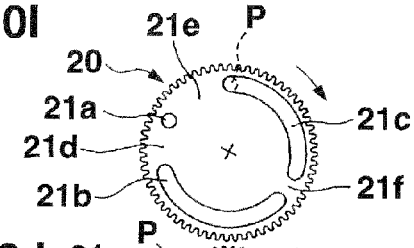
Figure 10J:
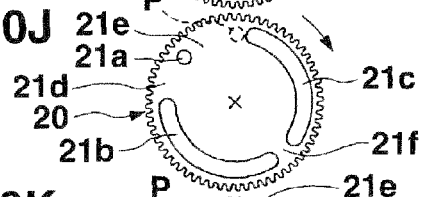

Then, as shown in FIG. 10I, until the seconds wheel 20 rotates two steps at a time so that its total rotational angle is 300 degrees, the arcuate aperture 21*c* aligns partially with the detection position P. Thus, as shown at 34- to 50-seconds position in FIG. 8, the detection unit 13 detects light continuously. As shown in FIG. 10J, when the arcuate aperture 21*c* in the seconds wheel 20 moves clockwise from the detection position P and the second light blocking area 21*e* blocks the detection position P, the detection unit 13 can not detect light, as shown at a 52-second position in FIG. 8.

Figure 10K:
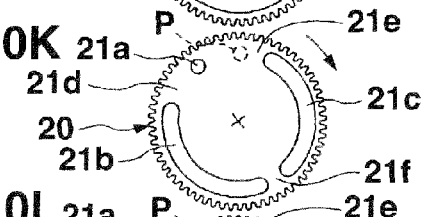
Figure 10L:
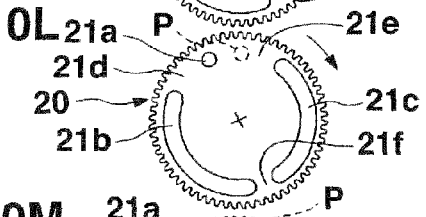
Figure 10M:
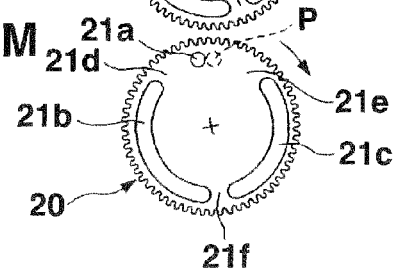

Similarly, as shown in FIGS. 10K to 10M, until the seconds wheel 20 rotates two steps at a time so that its total rotational angle is 348 degrees, the light blocking area 21*e* covers the detection position P. Thus, the detection unit 13 cannot detect light. Thus, as shown at 54- to 58-second positions in FIG. 8, four non-detection events occur successively. When the seconds wheel 20 rotates two steps from this state until its total rotational angle is 360 degrees, the aperture 21*a* in the seconds wheel 20 aligns with the detection position P, as shown in FIG. 10A. Thus, as shown at a 00-second positions in FIG. 8, the detection unit 13 detects light.

As described above, in the state of FIG. 10A, the detection unit 13 can detect light. In the states of FIGS. 10B to 10D, the detection unit 13 can not detect light successively three times. In the states of FIGS. 10E and 10F, the detection unit 13 can detect light successively. In the state of FIG. 10G, the detection unit 13 cannot detect light. In the states of FIGS. 10H and 10I, the detection unit 13 can detect light successively. In the states of FIGS. 10J to 10M, the detection unit 13 can not detect light successively four times.

As will be known from the above, the detection unit 13 cannot detect light in both the states of FIGS. 10B to 10D and FIGS. 10J to 10M. When the detection unit 13 tries to detect light once every two steps, in the former state three non-detection events occur successively whereas in the latter case four non-detection events occur successively. It will be known that the former and latter cases are different in the number of successive non-detection events. By counting this number of successive non-detections, the reference position in the seconds wheel 20 can be located as follows.

More particularly, each time the seconds wheel 20 rotates two steps or seconds, the detection unit 13 tries to detect light. When four successive non-detection events occur and the detection unit 13 detects light in the next two steps, the aperture 21*a* aligns with the detection position P. Thus, it will be known that the reference or 00-second position in the seconds wheel 20 has aligned with the detection position P. If the number of non-detection events is counted from the state of FIG. 10B, non-detection events occur three times successively until the state of FIG. 10D comes. Then, in the state of FIG. 10E, the detection unit 13 can detect light. Thus, the conditions of four successive non-detection events are not met and it will be known that the reference position in the seconds wheel 20 has not aligned with the detection position P. This is the basic position detecting process for detecting the reference position in the seconds wheel 20.

Then, referring to FIGS. 11A to 11P, description will be made of a basic process for detecting the respective reference positions in the hour and minute wheels 27 and 25. In this process, the seconds wheel 20 in the first driving system is ignored. FIGS. 11A to 11M illustrate that the center wheel 25 has rotated one step or degree at a time, thereby causing the intermediate wheel 23 to make one rotation. FIGS. 11M and 11N illustrate that the center wheel 25 has rotated 360 steps or degrees, thereby rotating the hour wheel 27 by 30 degrees. FIG. 11N to 11O show that the hour wheel 27 has rotated 9 hours from the state of FIG. 11N (in total, 10 hours so far). FIGS. 11O and 11P show that the hour wheel 27 has rotated one more hour (in total, 1 hours so far).

Figure 11A:
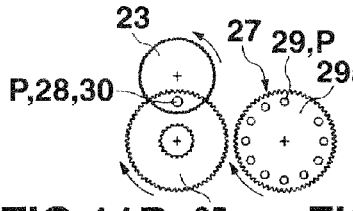

Both the reference or 0-o'clock and 00-minute positions in the center and hour wheels 25 and 27 can be detected best in the state of FIG. 11A. The reference position of the aperture 28 in the center wheel 25 is a 00-minute position and the reference position of the relevant one of the apertures 29 in the hour wheel 27 is a 0-o'clock position. Thus, it is required to detect the reference positions in the center and hour wheels 25 and 27 which align with the detection position P and the aperture 30 in the intermediate wheel 23.

Figure 11B:
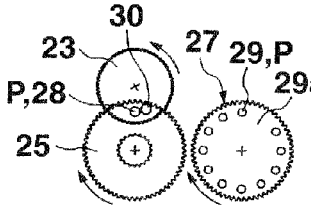
Figure 11C:
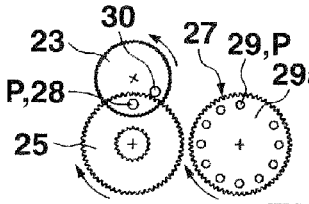
Figure 11D:
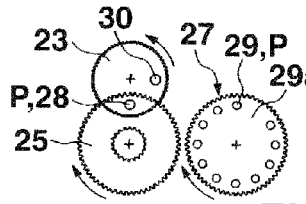
Figure 11E:
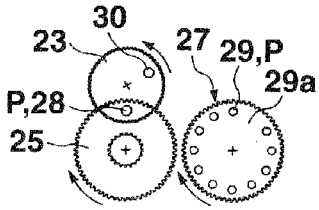
Figure 11F:
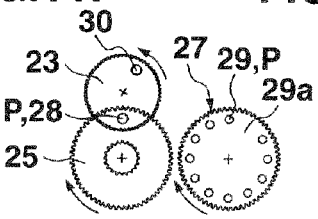

When the center wheel 25 is rotated clockwise one step or degree in FIG. 11A, the intermediate wheel 23 rotates 30 degrees, its aperture 30 moves counterclockwise away from the detection position P, and then the intermediate wheel 23 covers the detection position P, as shown in FIG. 11B. At this time, the center wheel 25 rotates clockwise one degree, and its aperture 28 moves slightly, but not completely, away from the detection position P in the detection unit 13 and hence the detection unit 13 can still detect light.

Figure 11G:
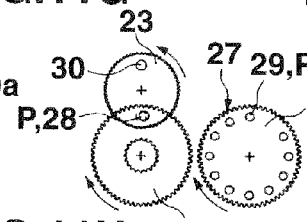
Figure 11H:
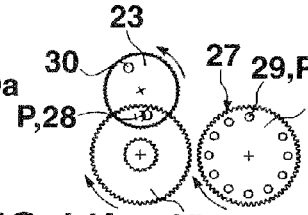
Figure 11I:
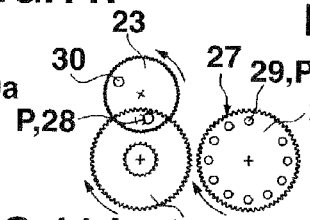
Figure 11J:
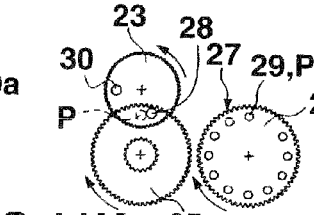
Figure 11K:
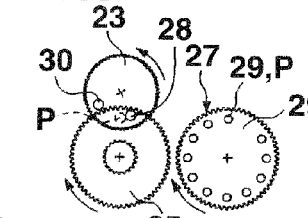
Figure 11L:
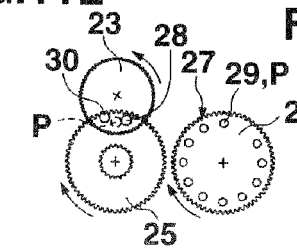
Figure 11M:
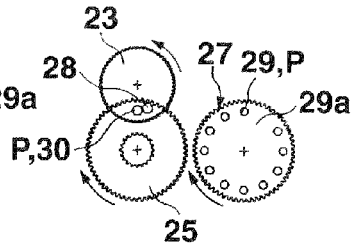
Figure 11N:
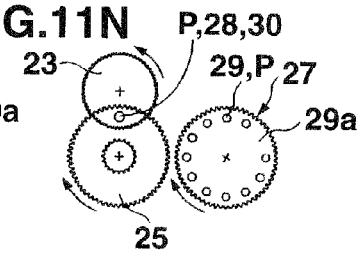
Figure 11O:
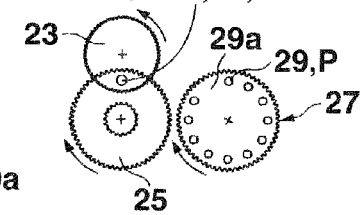
Figure 11P:
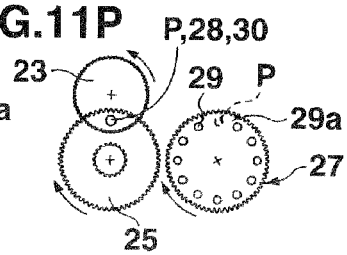
Figure 25:
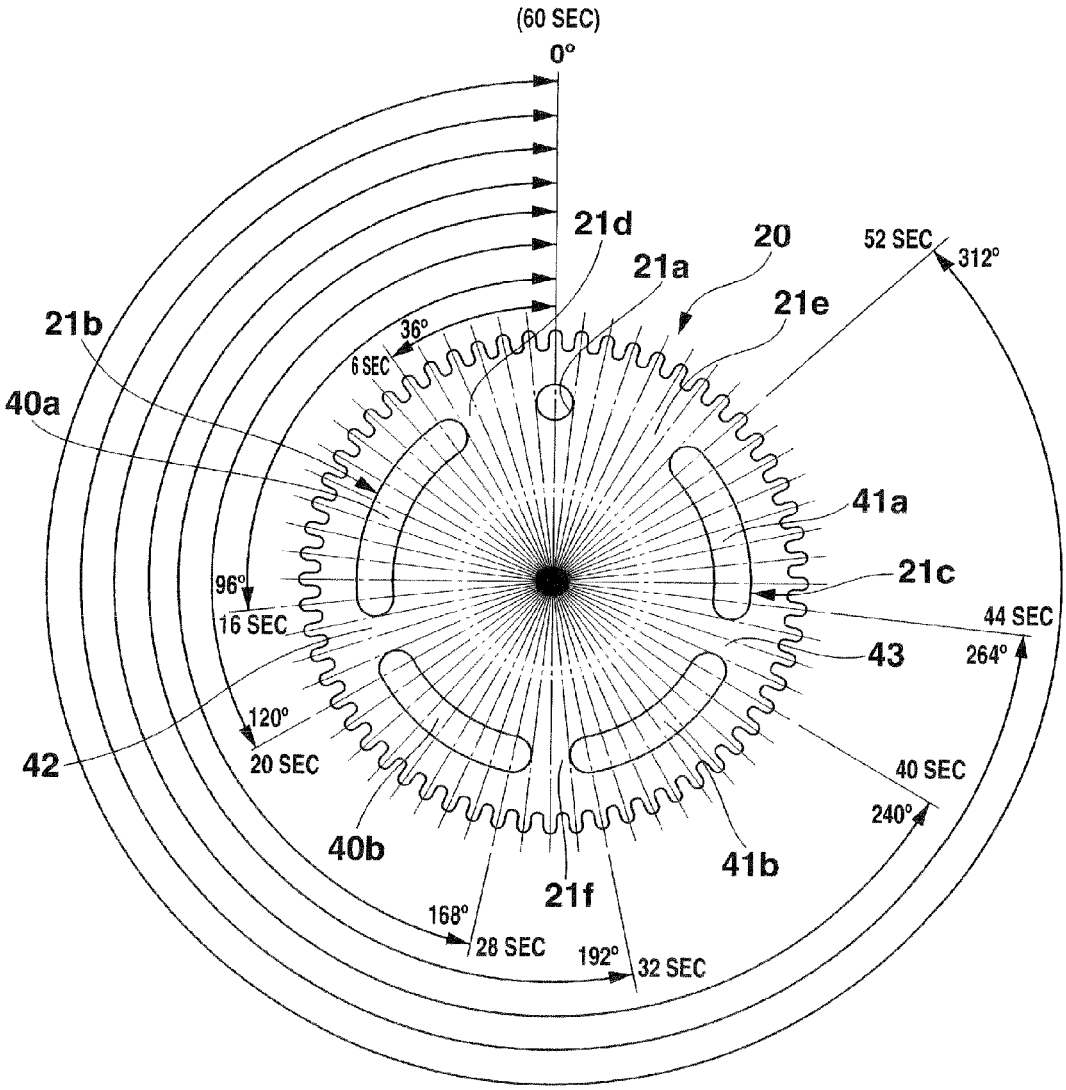
FIG. 25 is an enlarged plan view of a second modification of the seconds wheel in this embodiment.

Then, when the center wheel 25 rotates clockwise one step at a time and hence 6 steps or degrees in total, the intermediate wheel 23 rotates 180 degrees clockwise, its aperture 30 rotates counterclockwise 180 degrees away from the detection position P, and thus the intermediate wheel 23 continues to cover the detection position P, as shown in FIG. 11G. At this time, the center wheel 25 rotates 6 degrees clockwise and its aperture 28 becomes offset a half of its size from the detection position P, but the detection unit 13 still detects light (FIG. 25).

Then, when the center wheel 25 rotates clockwise one step at a time until 12 steps or degrees in total are reached, the intermediate wheel 23 rotates 360 degrees and its aperture 30 aligns with the detection position P, as shown in FIG. 11M. At this time, the aperture 28 in the center wheel 25 is substantially completely away from and aligns hardly with the detection position P. The center wheel 25 covers the detection position P, which can not detect light. At this time, since the hour wheel 27 rotates only one degree, the circular aperture 29 at the reference position in the hour wheel 27 becomes offset only slightly from the detection position P and the detection unit 13 can still detect light.

When the center wheel 25 rotates 360 steps or makes one rotation clockwise from the state of FIG. 11A, the apertures 28 and 30 in the minute and intermediate wheel 25 and 23 align with the detection position P, as shown in FIG. 11N. At this time, the hour wheel 27 has rotated 30 degrees clockwise from the state of FIG. 11A; the aperture 29 at the reference position in the hour wheel 27 has moved away from the detection position P; a second left aperture from the aperture 29 at the reference position aligns with the detection position P; and hence the detection unit 13 can detect light. When the center wheel 25 rotates 9 hours (or 10 hours in total) from this state, the apertures 28 and 30 in the minute and intermediate wheels 25 and 23 align with the detection position P, as shown in FIG. 11O. At this time, the hour wheel 27 has rotated 300 degrees. Thus, an eleventh aperture present counterclockwise from the aperture 29 at the reference position aligns with the position P and the detection unit 13 can detect light.

Then, when the center wheel 25 rotates further one hour (or 11 hours in all), the apertures 28 and 30 in the minute and intermediate wheels 25 and 23 align with the detection position P, as shown in FIG. 11P. At this time, the hour wheel 27 has rotated 330 degrees; the eleventh aperture from the aperture 29 at the reference position has moved away from the detection position P; and the light blocking area 29*a* in the hour wheel 27 covers the detection position P. Thus, the detection unit 13 cannot detect light. That is, it can be said that the hour wheel 27 is at an 11-o'clock 00-minute position.

When the center wheel 25 rotates further for one hour (or 12 hours in all), the apertures 28 and 30 in the center and intermediate wheels 25 and 23 align with the detection position P, as shown in FIG. 11A. At this time, the hour wheel 27 has rotated 360 degrees; the light blocking area 29*a* of the hour wheel 27 has moved away from the detection position P; and the aperture 29 at the 0-o'clock position in the hour wheel 27 aligns with the detection position P. That is, the hour wheel 27 returns to the state of FIG. 11A (0-o'clock 00-minute position).

As described above, since a rotational quantity of the center wheel 25 for one step is very small or one degree, it is not enough for the rotational amount per step of the center wheel 25 to cause the aperture 28 to move completely away from the detection position P, and the reference position in the center wheel 25 can not be detected accurately. The intermediate wheel 23 rotates 30 degrees per one step. Thus, even when the rotational amount per step of the center wheel 25 is small, the rotational amount of the intermediate wheel 23 is large enough to cover the detection position P.

As shown in FIG. 11M, when the intermediate wheel 23 makes one rotation in 12 steps, the center wheel 25 rotates 12 degrees. Thus, the aperture 28 in the center wheel 25 moves completely away from the detection position P and hence the center wheel 25 covers the detection position P. At this time, even when the aperture 30 in the intermediate wheel 23 aligns with the detection position P, the detection unit 13 cannot detect light.

Each time the center wheel makes one rotation in 360 steps to return to the detection point P, the apertures 28 and 30 in the center and intermediate wheels 25 and 23 and a relevant one of the apertures 29 in the hour wheel 27 align with the detection position P (excepting the aperture 29*a* at the 11 o'clock position in the hour wheel 27). Thus, the detection unit 13 can detect light when its reference or 0-degree position aligns with the detection position P each time the center wheel 25 makes one rotation in spite of the rotational position of the hour wheel 27 excluding the 11 o'clock position.

When the center wheel 25 rotates 360 steps or one rotation at a time after the reference or 0° position in the center wheel 25 is detected, the hour wheel 27 rotates 30 degrees at a time. Thus, even if the detection unit 13 does not detect light each time the center wheel 25 rotates one step at a time, the rotational position of the hour wheel 27 can be detected if the detection unit 13 tries to detect light only when the center wheel 25 makes one rotation. At this time, even if the detection unit 13 tries to detect light by rotating the center wheel 25 by 360 steps at a time from the state of FIG. 11O, the detection unit 13 cannot detect light because the light blocking area 29*a* in the hour wheel 27 has covered the detection position P, as shown in FIG. 11P. The reference position in the hour wheel 27 at this time is specified as an "11-o'clock 00-minute position".

When the center wheel 25 is further rotated 360 degrees from this "11-o'clock 00-minute position", the aperture 29 at the reference or 0-o'clock position in the hour wheel 27 aligns with the detection position P and the detection unit 13 can detect light. That aperture 29 in the hour wheel 27 at this time is at the reference or 0-o'clock 00-minute position. Thus, each time the center wheel 25 rotates 360 degrees or makes one rotation from the state in which the detection unit 13 can detect light, the detection unit 13 tries to detect light. Then, when the position in the hour wheel 25 (FIG. 11A) where the detection unit 13 can detect light is found by rotating the center wheel 25 further 360 degrees from the position where the detection unit 13 can not detect light (FIG. 11P), the position found can be specified as the reference or 0-o'clock 00 minute position in the hour wheel 27.

Referring to FIGS. 12A to 14F, description will be made of a basic 3-hand detection process for detecting the positions of the seconds, center and hour hands 2, 3 and 4. This process comprises a seconds hand position detecting operation to be performed when any of the apertures 21*a*, 21*b* and 21*c* in the seconds wheel 20 is offset from the detection position P, an hour/minute hand position detecting process to be performed when the aperture 28 in the center wheel 25 or a relevant one of the apertures 29 in the hour wheel 27 is offset from the detection position P, and a combination of the seconds hand position detecting operation and hour/minute hand position detecting process to be performed when one of the apertures 21*a*, 21*b* and 21*c* in the seconds wheel 20, the aperture 28 in the center wheel 25 and a relevant one of the apertures 29 in the hour wheel 27 are all offset from the detection position P.

First, referring to FIGS. 12A to 12F, description will be made of the three-hand position detecting process to be performed when only the aperture 21 in the seconds wheel 20 is offset from the detection position P. At this time, assume that the state of the seconds wheel 20 is completely unknown and that the reference positions in the center and hour wheels 25 and 27 are a 0-o'clock and 00-minute position. First, a basic seconds hand position detecting process to detect the reference position in the seconds wheel 20 will be tried by rotating the seconds wheel 20 clockwise two steps at a time, thereby causing the detection unit 13 to detect light on each such occasion.

Figure 12A:
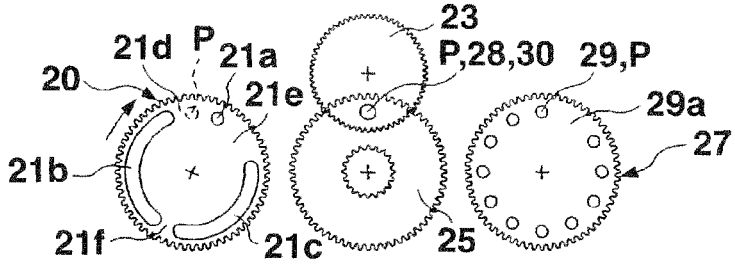
FIGS. 12A, 12B, 12C, 12D, 12E and 12F show a position detecting operation for the seconds wheel alone in FIG. 5, illustrating the respective states of the seconds wheel obtained in corresponding stages where the seconds wheel whose reference position is offset from the detection position is moved to the same.

If at this time the state of FIG. 12A is obtained, the detection unit 13 can not detect light, and this state is counted as one non-detection event. When such states successively occur, the number of these non-detection events is sequentially counted up and then when the detection unit 13 detects light, the count obtained so far is cleared.

Figure 12B:
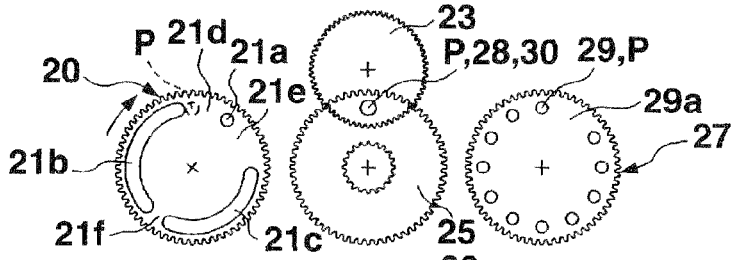
Figure 12C:
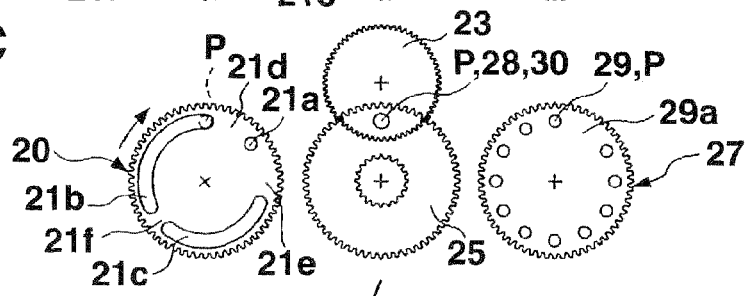
Figure 12D:
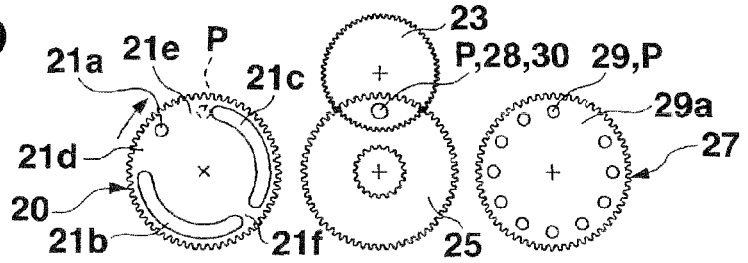

When the detection unit 13 cannot detect light, the seconds wheel 20 is rotated further two steps, thereby causing the detection unit 13 to try to detect light. As shown in FIG. 12B, if at this time the detection unit 13 can not detect light, it is determined that another non-detection event has occurred and hence is counted. Then, the seconds wheel 20 is rotated further two steps from this state, thereby causing the detection unit 13 to try to detect light. If the detection unit 13 detects light at this time, as shown in FIG. 12C, non-detection events do not occur successively, and the counted number of non-detection events obtained so far is cleared.

Figure 12E:
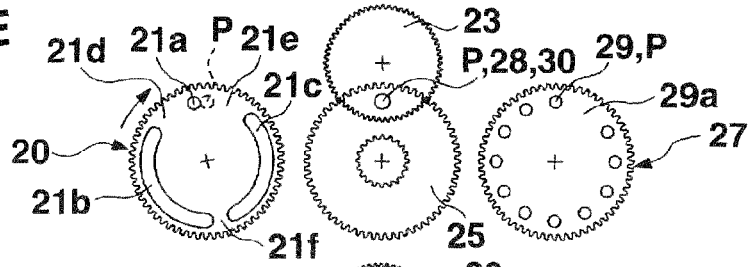

Subsequently, the detection unit 12 tries to detect light each time the seconds wheel 20 is rotated two steps. As shown FIG. 12D, at this time, when a state where the detection unit 13 cannot detect light occurs after the detection unit 13 has successfully detected light successively so far, this state is counted again as one non-detection event. Then, light detection is tried each time the seconds wheel 20 is rotated two steps. At this time, four non-detection events occur successively in which the detection unit 13 cannot detect light, as shown in FIG. 12E.

Figure 12F:
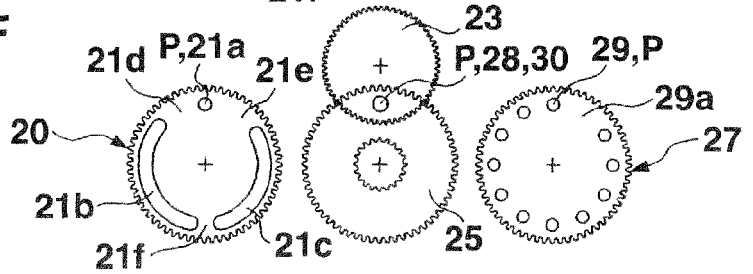

If the detection unit 13 can detect light in next two steps, it can be said that the aperture 21*a* in the seconds wheel 20 has aligned with the detection position P. Thus, it will be known that the position of the aperture 21*a* is its reference position, as shown in FIG. 12F.

Then, referring to FIGS. 13A to 13F, description will be made of the three-hand position detection process to be performed when the apertures 28 and 29 in the center and hour wheels 25 and 21 are offset from the detection position P. At this time, even when the aperture 21 in the seconds wheel 20 aligns wholly or partially with the detection position P, the apertures in the center and hour wheels 25 and 27 do not align with the detection position P. Thus, the detection unit 13 cannot detect light. Therefore, first, a basic seconds hand position detection to move the reference position in the seconds wheel 20 to the detection position P will be performed.

Figure 13A:
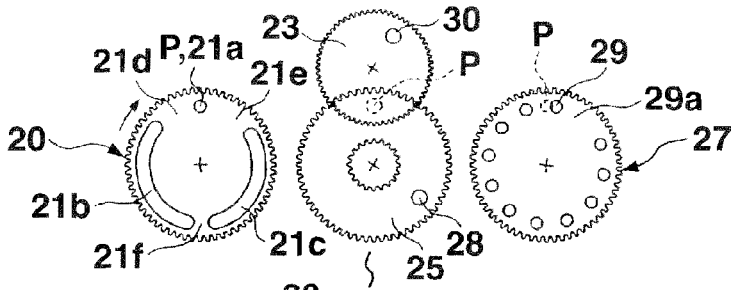
FIGS. 13A, 13B, 13C, 13D, 13E and 13F show a position detecting operation for the center and hour wheels in FIG. 5, illustrating the respective states of each of the seconds and hour wheels obtained in corresponding stages where the center and hour wheels whose reference positions are offset from the detection position P are moved to the same.
Figure 13B:
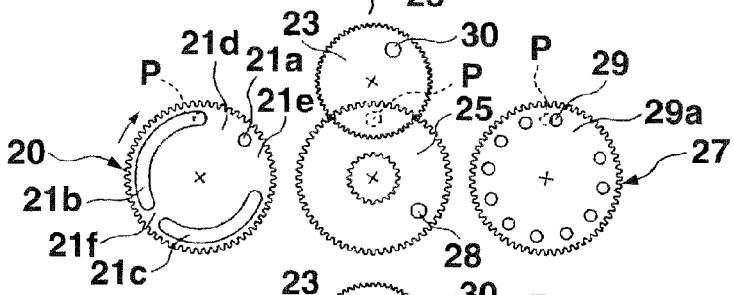

At this time, when the seconds wheel 20 is rotated two steps at a time, thereby causing the detection unit 13 to detect light each time, the state changes from the state of FIG. 13A to that of FIG. 13B. Thus, even when the aperture 21 in the seconds wheel 20 aligns with the detection position P, the apertures 28 and 29 in the center and hour wheels 25 and 27 are offset from the detection position P, and the detection unit 13 cannot detect light. When the state of the seconds wheel 20 changes from 13A to 13B, four non-detections events have occurred successively.

Figure 13C:
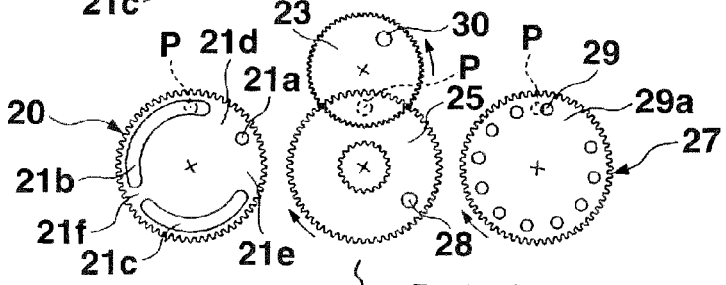

The basic seconds wheel position detecting method involves the fact that if the detection unit 13 tries to detect light, encounters four non-detection events successively and detects light in next two steps, the position of the aperture in the seconds wheel 20 at this time is a reference position in the seconds wheel 20. In view of this method, in the state of FIG. 13B, four non-detection events have occurred successively. Thus, if the detection unit 13 detects light in next two steps, it can be said that the position of the aperture in the seconds wheel 20 at this time is the reference position in the seconds wheel 20. However, as shown in FIG. 13C, the apertures 28 and 29 in the center and hour wheels 25 and 27 are offset from the detection position P even when the seconds wheel 20 is rotated two steps. Thus, the detection unit 13 cannot detect light.

Thus, the detection unit 13 cannot detect light successively five times once each time the seconds wheel 20 rotates two steps. Thus, it will be known that either the aperture 28 in the center wheels 25 or any of the apertures 29 in hour wheel 27 is offset from the detection position P. In this state, it is unknown whether the aperture 21 in the seconds wheel 10 aligns wholly or partially with the detection position P.

Since it is known at this point that either the apertures 28 in the center wheels 25 or any of the apertures 29 in the hour wheel 27 is offset from the detection position P, a trial will be made of a basic process for detecting the reference positions in the center and hour wheel 25 and 27. To this end, the seconds wheel 20 is rotated one step at a time, thereby causing the detection unit 13 to detect light. Therefore, when the state of the center and hour wheels 25 and 27 changes from that of FIG. 13C to that of FIG. 13D, the apertures 28 and 30 in the center and intermediate wheels 25 and 23 align with the detection position P and a relevant one of the apertures 29 in the hour wheel 27 also aligns with the detection position P. Thus, the detection unit 13 can detect light.

Thus, it is known that the reference or 00-minute position in the center wheel 25 has aligned with the detection position P. At this time, it is unknown at which rotational positions the seconds and hour wheels 20 and 27 are. In this case, the detection unit 13 can detect light. Thus, a basic seconds position detecting process for detecting the reference position in the seconds wheel 20 is tried by moving the seconds wheel 20 to the position of FIG. 13E where the reference or 00-second position in the seconds wheel 20 aligns with the detection position P. Thus, it is known that the respective reference positions in the seconds and center wheels 20 and 25 are at a 00-minute and 00-second position.

Then, when the center wheel 25 is rotated 360 degrees or one rotation at a time, the respective apertures 29 in the hour wheel 27 align sequentially with the detection position P. The detection unit 13 can detect light. Thus, when the center wheel 25 is further rotated 360 degrees from the state or 11 o'clock position where the detection unit 13 cannot detect light, the reference or 0-o'clock position in the hour wheel 27 aligns with the detection position P. Thus, at this time the respective reference positions in all the seconds, center and hour wheels 20, 25 and 27 are at the 0-o'clock 00-minute 00-second position, which occurs at 0 o'clock, 00 minutes, 00 seconds.

Figure 14A:
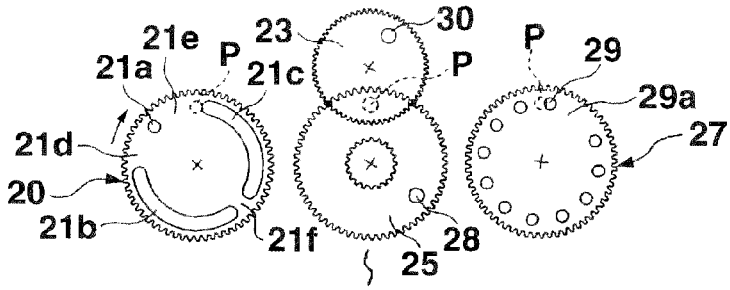
FIGS. 14A, 14B, 14C, 14D, 14E and 14F show a basic position detecting operation for the seconds, center and hour wheels in FIG. 5, illustrating the respective states of each of the seconds, center and hour wheels obtained in corresponding stages where the seconds, center and hour wheels whose reference positions are offset from the detection position P are moved to the same.
Figure 14B:
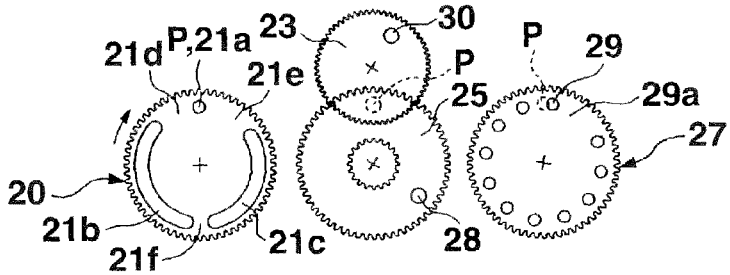

Then, referring to FIGS. 14A to 14F, description will be made of a three-hand position detecting process for detecting the three-hand positions when any of the apertures 21, 28 and 29 in the seconds, center and hour wheels 20, 25 and 27 is offset from the detection position P. At this time, the rotational positions of these wheels 20, 25 and 27 are unknown. Thus, a basic seconds hand position detecting process for detecting the reference position of the seconds wheel 20 will be tried by rotating the seconds wheel 20 two steps at a time from the state of FIG. 14A. As shown in FIG. 14B, at this time even when the aperture 21 in the seconds wheel 20 aligns wholly or partially with the detection position P, the detection unit 13 cannot detect light if none of the apertures 28 and 29 in the center and hour wheels 25 and 27 aligns with the detection position P.

Figure 14C:
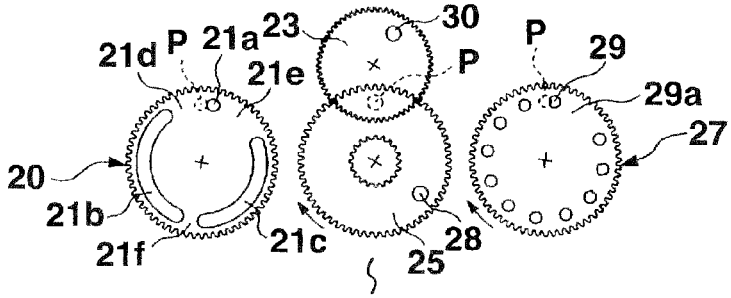

Therefore, the basic hand position detection for the seconds wheel 20 will be further performed. The conditions for detecting the reference position in the seconds wheel are that the detection unit 13 tries to detect light each time the seconds wheel 20 rotates two steps at a time, encounters four successive non-detection events, and then detects light successfully in next two steps. Thus, as shown in FIG. 14B, when these conditions hold, the reference position in the seconds wheel 20 at this time aligns with the detection position P and is detected. As shown in FIG. 14C, if the detection unit 13 cannot detect light even when the seconds wheel 20 rotates in the next two steps, it is determined that any of the apertures 28 and 29 in the center and hour wheels 25 and 27 is offset from the detection position P. At this time, it is also unknown whether the aperture 21 in the seconds wheel 20 has aligned with the detection position P.

Figure 14D:
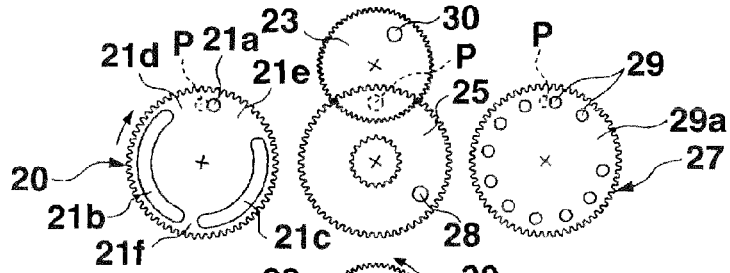

In this state, it is determined that the aperture 28 in the seconds wheel 25 is offset from the detection position P and then a basic position detecting process for detecting the reference positions in the center and hour wheels 25 and 27 will be tried by rotating the center wheel 25 one step at a time. As shown in FIG. 14C, if the detection unit 13 detects no light even when the center wheel 25 is rotated 360 degrees, the aperture 21 in the seconds wheel 20 is regarded as not aligning with the detection position P, as shown in FIG. 14D. Thus, the seconds wheel 20 is rotated further 30 steps or 180 degrees.

Figure 13D:
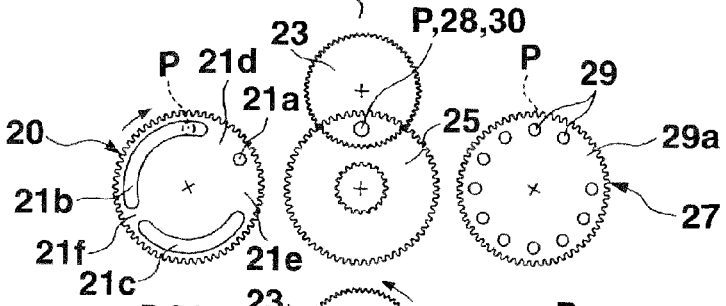
Figure 13E:
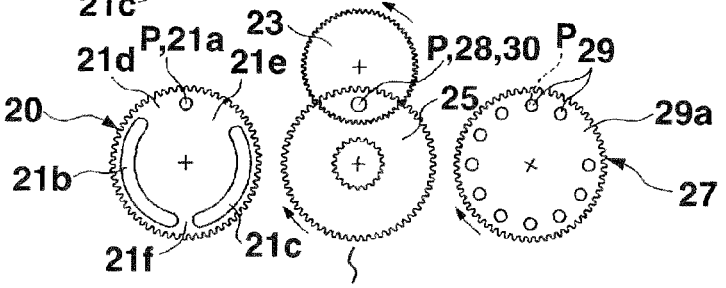
Figure 13F:
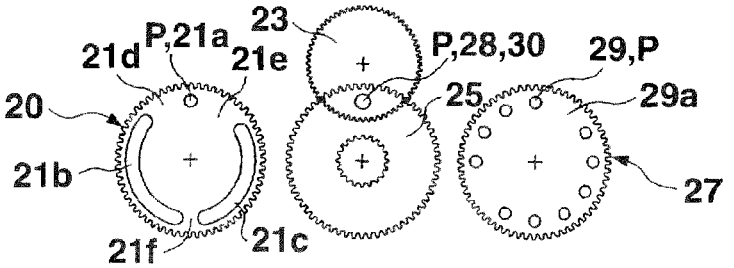
Figure 14E:
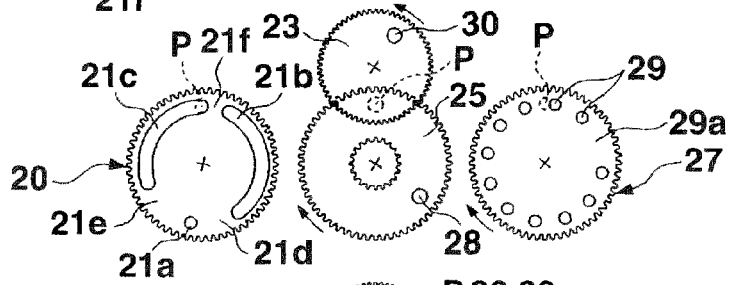
Figure 14F:
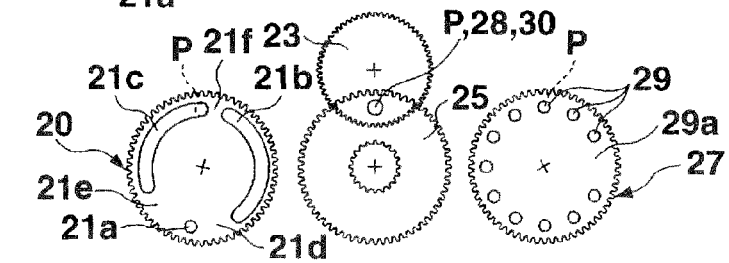

If the seconds wheel 20 is rotated 180 degrees or a half rotation when the aperture 21 in the seconds wheel 20 aligns neither wholly nor partially with the detection position P, the aperture 21 necessarily aligns wholly or partially with detection position P, as shown in FIG. 14E, which is assumed so. In this state, the center wheel 25 is again rotated one step at a time, thereby causing the detection unit 13 to detect light. At this time, if the aperture 28 in the center wheel 25 aligns with detection position P, thereby causing the detection unit 13 to detect light, it can be said that the reference or 00-minute position in the center wheel 25 is as shown in FIG. 14F. If appropriate operations as bring about the states of FIGS. 13E and 13F sequentially following the state of FIG. 13D are performed, all the reference positions in the seconds, center and hour wheel 20, 25 and 27 align.

Referring to FIGS. 15A to 15F, description will be made of a basic hand position confirming process for confirming whether at each of the time o'clock excluding 11 and 23 o'clock, the seconds, center and hour hands 2, 3 and 4 indicate the direction of that o'clock exactly in the usual hand driving operation. This process is performed by the CPU 35. In the case of the seconds hand, it should be confirmed in 10 seconds from the related time o'clock whether the seconds hand 2 is set correctly at each of the time o'clock excluding the 11 and 23 o'clock. This is because when 10 seconds elapse from the related time o'clock, the center wheel 25 is rotated one step or degree by the second stepping motor 22 of the second driving system 12, which rotates the intermediate wheel 23 by 30 degrees, thereby causing the light blocking area of the center wheel 25 to cover the aperture 30 in the intermediate wheel 23 and hence the detection position P.

Figure 15A:
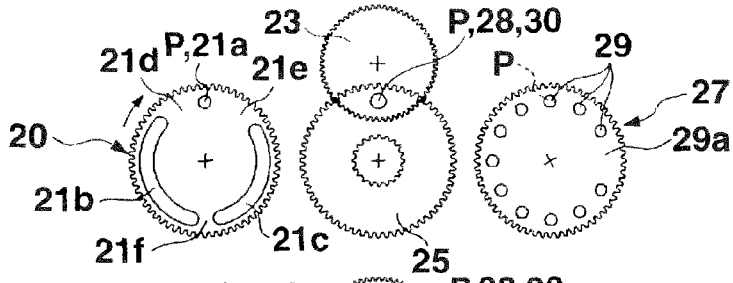
FIGS. 15A, 15B, 15C, 15D, 15E and 15F show a hand position confirming process for confirming whether at every time o'clock all the seconds, center and hour hands point to the direction of that o'clock in the normal hand driving operation, illustrating the respective operational positions which the seconds, center and hour wheels assume after two seconds have elapsed sequentially.

FIG. 15A shows that the apertures 21*a* and 28 in the seconds and center wheels 20 and 25, a relevant (for example, third) one of the apertures 29 in the hour wheel 27 and the aperture 30 in the intermediate wheel 23 align with the detection position P at a particular, for example 2, o'clock in the normal hand driving operation. From this state, the seconds wheel 20 rotates one step (or 6 degrees) at a time. Thus, the aperture 21*a* in the seconds wheel 20 does not completely move away from the detection position P and the detection unit 13 can detect light.

Figure 15B:
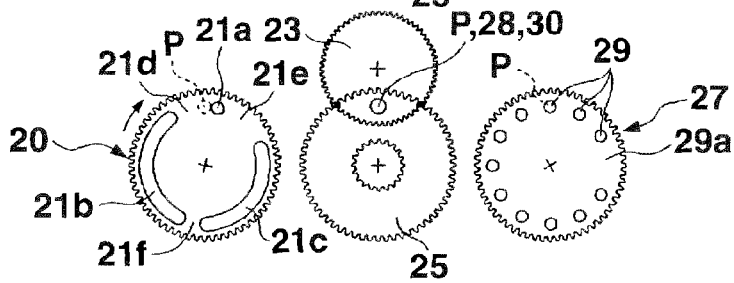

Then, when the seconds wheel 20 rotates further one step (or two steps or 12 degrees in all) to come to a 2-second position, the aperture 21*a* in the seconds wheel 20 moves completely away from the detection position P and the first light blocking area 21*d* covers the detection position P, as shown in FIG. 15B. Even if the detection unit 13 tries to detect light at this time, the detection unit 13 cannot detect light. Thus, this non-detection event is counted.

Figure 15C:
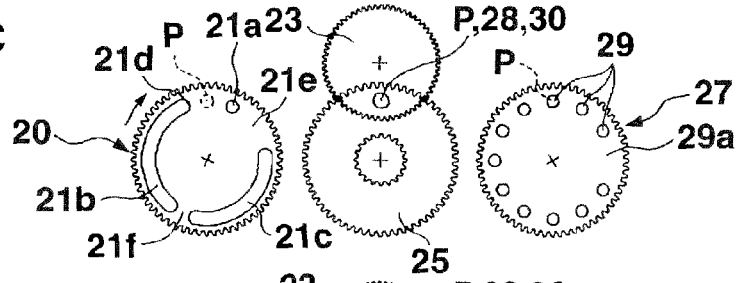
Figure 15D:
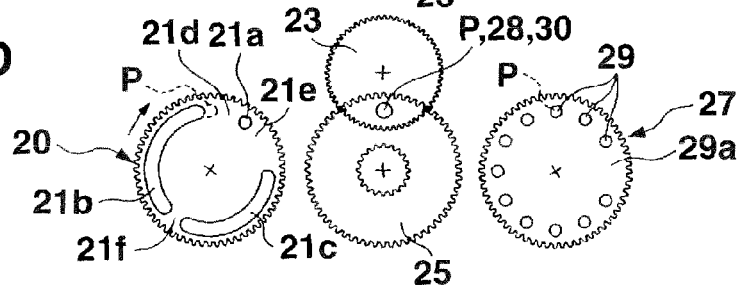

Further, the seconds wheel 20 rotates one step at a time and the detection unit 13 tries to detect light each time. At this time, the first light blocking area 21*d* of the seconds wheel 20 continuously covers the detection unit 13, as shown at 4- and 6-second positions in FIGS. 15C and 15D, respectively. Thus, as shown in FIGS. 15B to 15D, three non-detection events occurs successively.

Figure 15E:
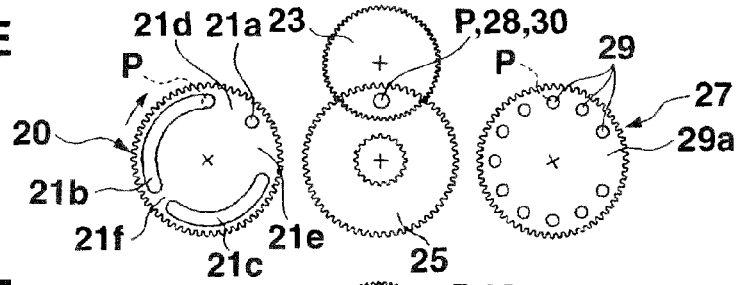

Then, when the seconds wheel 20 rotates further two steps from this state, and as shown at a 8-second position in FIG. 15E, the arcuate aperture 21*b* in the seconds wheel 20 aligns with the detection position P, thereby causing the detection unit 13 to detect light, and the aperture 21*a* at the reference position in the seconds wheel 20 is at an 8-second position. Thus, it will be known that the seconds wheel 20 rotates exactly and the seconds hand 2 sweeps around exactly. That is, each time the seconds wheel 20 rotates two steps at a time, starting from the related time o'clock position, the detection unit 13 tries to detect light. When the detection unit 13 encounters three non-detection events successively and then detects light, the seconds hand 2 is at the 8-second position. This indicates that the seconds hand 2 sweeps around exactly.

Figure 15F:
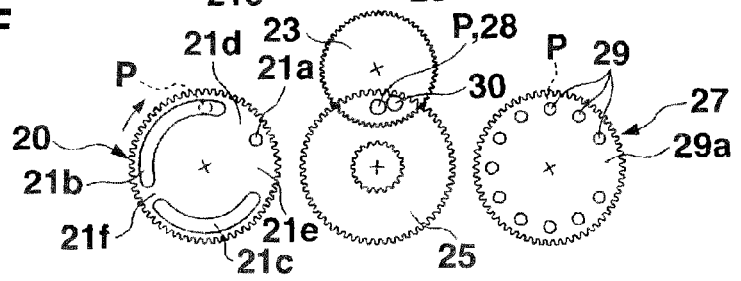

Then, when the seconds wheel 20 rotates further two steps or 10 seconds elapse, the arcuate aperture 21*b* in the seconds wheel 20 aligns with the detection position P and the detection unit 13 can detect light, as shown in FIG. 15F. In this case, the center wheel 25 rotates one step or degree and the intermediate wheel 23 rotates one step or 30 degrees. Thus, even if the aperture 28 in the center wheel 25 is not completely away from the detection position P, the aperture 30 in the intermediate wheel 23 is completely away from the detection position P, thereby causing the intermediate wheel 23 to cover the detection unit 13. Thus, hand setting in the usual hand driving operation is required to be performed in 10 seconds from the related time o'clock.

Figure 16:
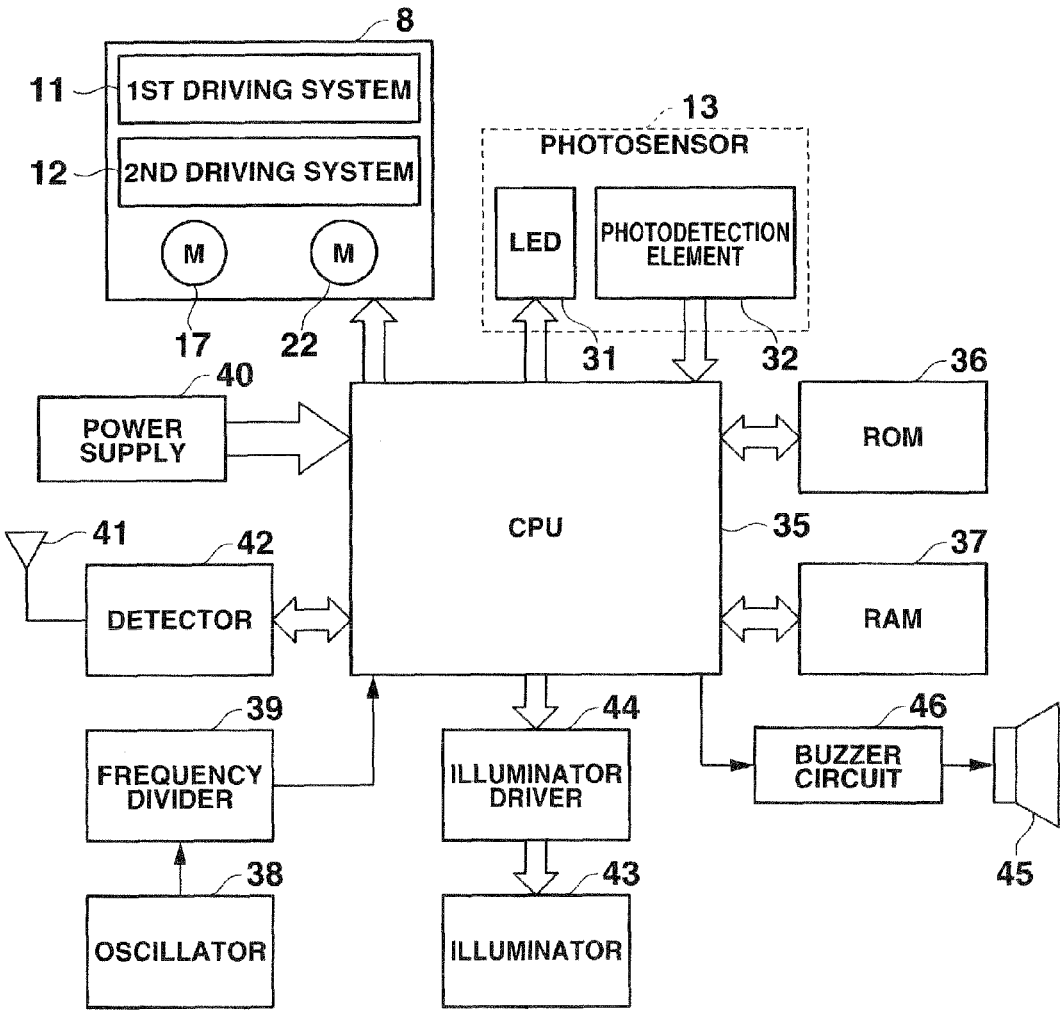
FIG. 16 is a block diagram of a circuit configuration of the wristwatch of this embodiment.

Then, referring to FIG. 16, the circuit configuration of this wristwatch comprises a CPU 35 which controls the whole circuit, a ROM 36 which has stored predetermined programs, a RAM 37 which stores data to be processed, an oscillator 38 which generates a pulse signal to operate the CPU 35, a frequency divider 39 which converts the pulse signal generated by the oscillator 38 to an appropriate frequency to operate the CPU 35, a watch movement 8 which causes the seconds, center and hour hands 2, 3 and 4 to sweep around the dial, and the detection unit 13 which comprises a light emission element 31 and a photodetection element 32 which detects light from the light emission element 31. While in this specification, various controlling and processing operations which are performed by the CPU 5 are indicated, the CPU 35 is not especially described conspicuously.

The circuit further comprises a power supply 40 which includes a solar panel 9, and a battery to supply power, an antenna 41 which receives a standard radio wave, a wave detector 42 which detects the received standard radio wave, an illuminator 43 which illuminates time indications, a driver 44 which drives the illuminator 43, a speaker 45 which emanates sound and a buzzer circuit 46 which drives the speaker 45.

Figure 17:
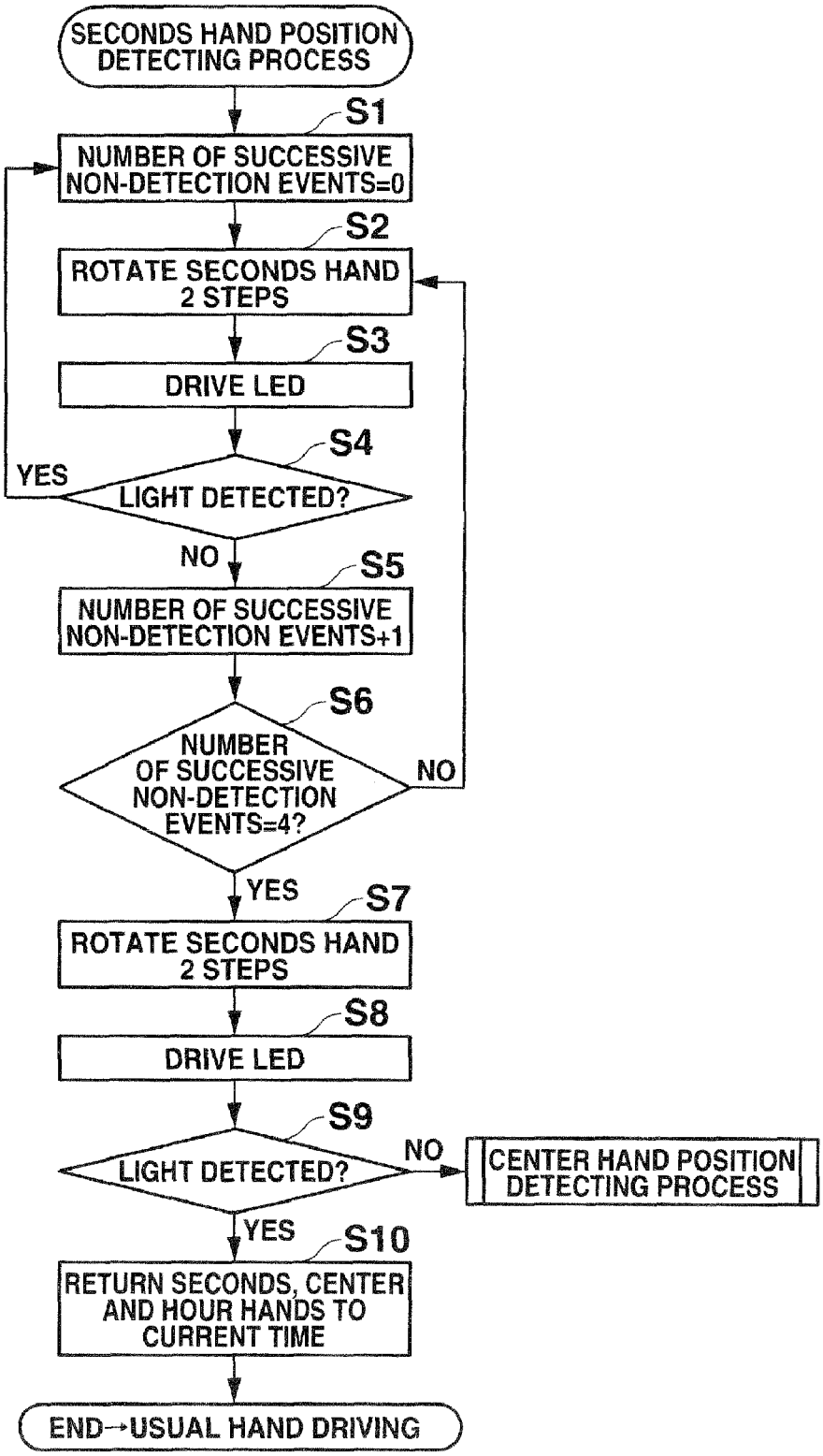
FIG. 17 is a flowchart indicative of a basic seconds hand position detecting process to move the seconds hand to the detection position P.

Then, referring to FIG. 17, description will be made of a basic seconds hand position detecting process for detecting the reference position of the seconds hand 2 of this wristwatch. This process includes detecting the reference or 00-second position in the seconds wheel 20 where the aperture 21*a* in the seconds wheel 20 aligns with the detection position P, as shown in FIG. 10A. In this case, it is assumed that the apertures 28 and 30 in the center and intermediate wheels 25 and 23 and a relevant one of the apertures 29 in the hour wheel 27 have aligned with the detection position P and that these wheels are at a stop.

When this process starts, the counted number of non-detection events which the detection unit 13 has encountered so far is cleared, thereby resetting a non-detection flag bit to 0 (step S1). Then, the motors 11 and 12 of the watch movement 8 are driven, thereby rotating the seconds wheel 20 two steps or 12 degrees (step S2). Further, the light emission element 31 of the detection unit 13 is caused to emit light (step S3) and then it is determined whether the photodetection element 32 has detected light from the light emission element 31 or whether the detection unit 13 has detected light (step S4).

When any of the apertures 21*a*, 21*b* and 21*c* in the seconds wheel 20 aligns wholly or partially with the detection position P, it is determined that the photodetection element 32 has detected light from the light emission element 31 and that the detection unit 13 has detected light. Then, control returns to the step S1 and then repeats the above operations of steps S1 to S4 until one of the light blocking areas 21*d* to 21*f* in the seconds wheel 20 blocks or covers the detection position P.

When the seconds wheel 20 rotates two steps at a time until the aperture 21 in the seconds wheel 20 is offset from the detection position P and any of the light blocking areas 21*d* to 21*f* in the seconds wheel 20 covers the detection position P, the photodetection element 32 detects no light from the light emission element 31. This non-detection event is counted, thereby setting the non-detection flag bit to "1" (step S5). Then, it is determined whether four non-detection events have occurred successively to the detection unit 13 (step S6).

This is because when the detection unit 13 detects light as shown in FIG. 10A after four non-detection events have occurred successively as shown in FIGS. 10J to 10M, the position in the seconds wheel 20 which has aligned with the detection position P is specified as the reference position in the seconds wheel 20. Thus, the light blocking area 21*d* of the seconds wheel 20 covers the detection position P, for example, in the states of FIGS. 10B to 10D. Therefore, three non-detections occur successively to the detection unit 13. Then, when the seconds wheel 20 rotates two steps, the arcuate aperture 21*b* in the seconds wheel 20 aligns partially with the detection position P, thereby causing the detection unit 13 to detect light. At this time, the control returns to the step S2, thereby repeating the steps S1 to S6.

Similarly, since in the state of FIG. 10G the light blocking area 21*f* of the seconds wheel 20 covers the detection position P, the detection unit 13 does not detect light. Then, when the seconds wheel 20 rotates two steps, the arcuate aperture 21*c* in the seconds wheel 20 aligns partially with the detection position P, and the detection unit 13 detects light. Also at this time, the control returns to the step S2 to repeat the steps S1 to S4. When the seconds wheel 20 rotates from the state of FIG. 10J to that of FIG. 10M, the light blocking area 21*e* of the seconds wheel 20 covers the detection position P, and four non-detection events occur successively to the detection unit 13.

Then, the seconds wheel 20 is rotated two steps (step S7), the light emission element 31 is caused to emit light (step S8), and then it is determined whether the photodetection unit 32 has received light from the light emission element 31 (step S9). If so, it can be said that the aperture 21*a* in the seconds wheel 20 has aligned with the detection position P. Thus, it is determined that the reference or 00-second position in the seconds wheel 20 has been detected. Then, a hand position correction process is performed, thereby returning the seconds, center and hour hands 2, 3, and 4 to the current time (step S10), and thus the watch is returned to its usual hand driving operation, thereby terminating this process.

In step S9, it is assumed that the respective apertures 28 and 30 in the center and intermediate wheel 25 and 23 and a relevant one of the apertures 29 in the hour wheel 27 have aligned with the detection position P and are at a stop there. Thus, the detection unit 13 necessarily detects light. However, if none of the apertures 28, 29 and 30 in the center, hour and intermediate wheel 25, 27 and 23 has aligned with the detection position P, the detection unit 13 will detect no light. Thus, the control passes to an hour and minute hand detecting process which will be described next.

Figure 18:
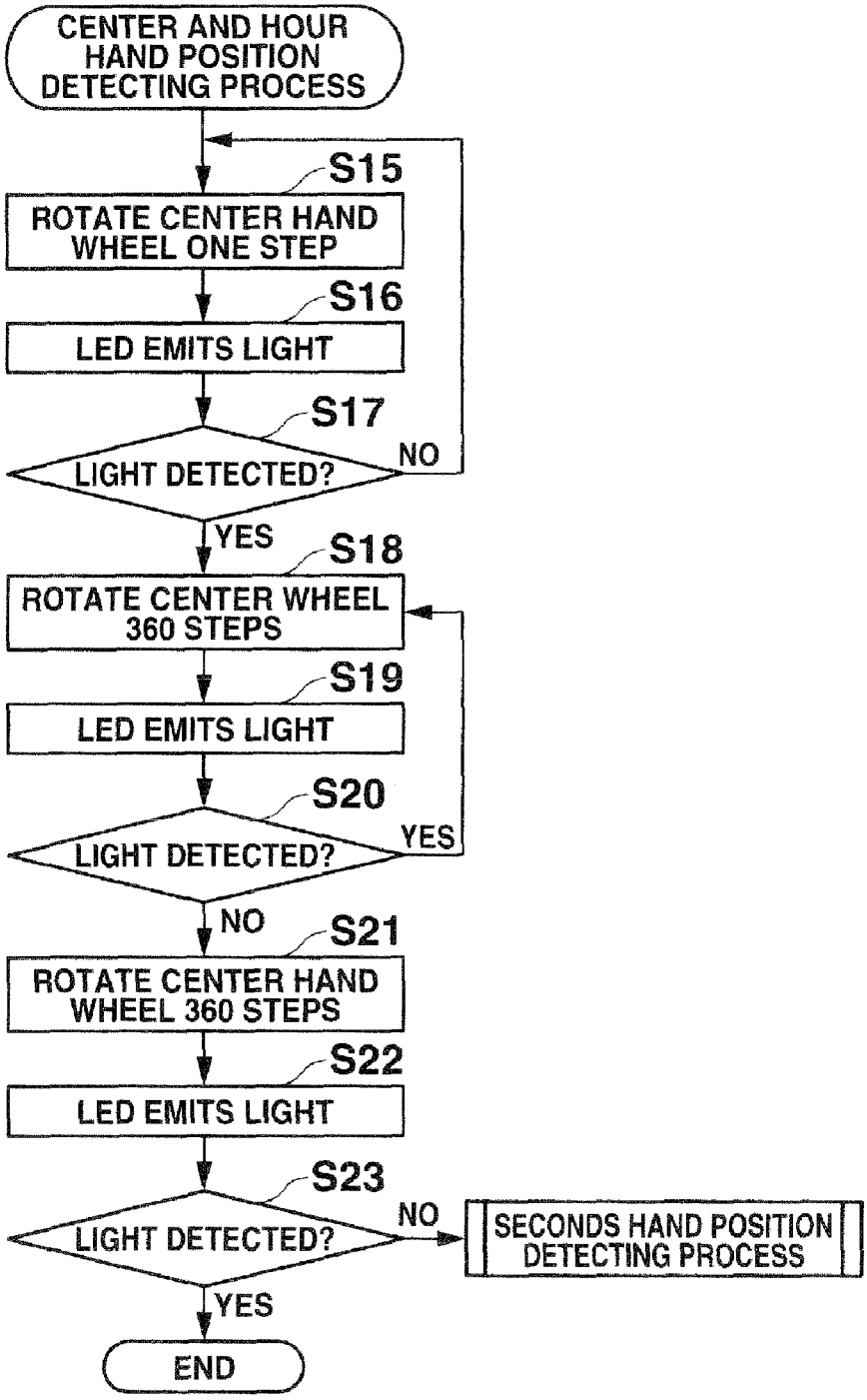
FIG. 18 is a flowchart indicative of a basic hour and center hand position detecting process to move the center and hour hands to the detection position P.

Then, referring to FIG. 18, description will be made of a basic hour and center hand position detecting process for detecting the reference positions of the center and hour hands 3 and 4 of the hand type wristwatch. As shown in FIG. 11A, this process involves detecting the respective reference positions in the center and hour wheels 25 and 23, which is achieved by detecting the respective reference positions in the center and hour wheels 25 and 27 when the aperture 28 in the center wheel 25, the aperture 29 provided at its reference position in the hour wheel 27 and the aperture 30 in the intermediate wheel 23 have aligned with the detection position P. In this case, assume that the seconds wheel 20 has also aligned at its aperture 21 with the detection position P and is at a stop.

When this process starts, the center wheel 25 is rotated clockwise one step or degree (step S15), the light emission element 31 is caused to emit light (step S16), and then it is determined whether the photodetection element 32 has received light from the light emission element 31 (step S17). If not, the control repeats the steps S15 to S17 until the seconds wheel 25 is rotated 360 degrees or one hour. In this case, it is assumed that the aperture 21 in the seconds wheel 20 has aligned with the detection position P. Thus, when the center wheel 25 rotates 360 degrees, the detection unit 13 detects light necessarily, excluding at the "11 o'clock position", as shown in FIG. 11N.

When the detection unit 13 detects light in the step S17, it is determined that the reference or 00-minute position in the center wheel 25 has aligned with the detection position P. Then, the center wheel 25 is rotated further 360 degrees, thereby rotating the hour wheel 27 by 30 degrees (step S18). Then, the light emission element 31 is caused to emit light (step S19). Then, it is determined whether the photodetection element 32 has received light from the light emission element 31 and hence whether a relevant one of the apertures 29 in the hour wheel 27 has aligned with the detection position P, thereby causing the detection unit 13 to detect light (step S20).

At this time, the hour wheel 27 has the 11 apertures 29 disposed at angular intervals of 30 degrees along the periphery of the hour wheel 27 with the light blocking area 29*a* at the 11 o'clock position. Thus, when the center wheel 25 rotates 360 degrees and hence the hour wheel 27 rotates 30 degrees, the apertures 29 in the hour wheel 27 sequentially align with the detection position P, as shown in FIGS. 11N and 11O, and the detection unit 13 detects light excluding in the light blocking area 29*a* at the 11 o'clock position. When in the step S20 the detection unit 13 detects light, the control returns to the step S18 to repeat the operations in the steps S18 to S20 until the apertures 29 in the hour wheel 27 sequentially align with the detection position P and the light blocking area 29*a* of the hour wheel 27 covers the detection position P, thereby preventing the detection unit 13 from detecting light.

As shown in FIG. 11P, if the detection unit 13 detects no light due to the fourth light blocking area 29*a* of the hour wheel 27 covering the detection position P, it is determined that the 11 o'clock position in the hour wheel 27 has aligned with the detection position P, and the center wheel 25 is rotated further 360 degrees, thereby rotating the hour wheel 27 further 30 degrees (step S21). Then, the light emission element 31 is caused to emit light (step S22), and then it is determined whether the photodetection element 32 has detected light from the light emission element 31 and hence whether the detection unit 13 has detected light (step S23).

As shown in FIG. 11A, in step S23 the aperture 29 at the "0-o'-clock position in the hour wheel 27 aligns necessarily with the detection position P and the detection unit 13 detects light. Thus, it is confirmed that the reference or 0-o'clock position in the hour wheel 27 has aligned with the detection position P, and then this process is terminated. It is assumed in step S23 that the aperture 21 in the seconds wheel 20 has aligned wholly or partially with the detection position P. Thus, the detection unit 13 should necessarily detect light. Otherwise, then the control returns to the seconds hand position detecting process.

Figure 19:
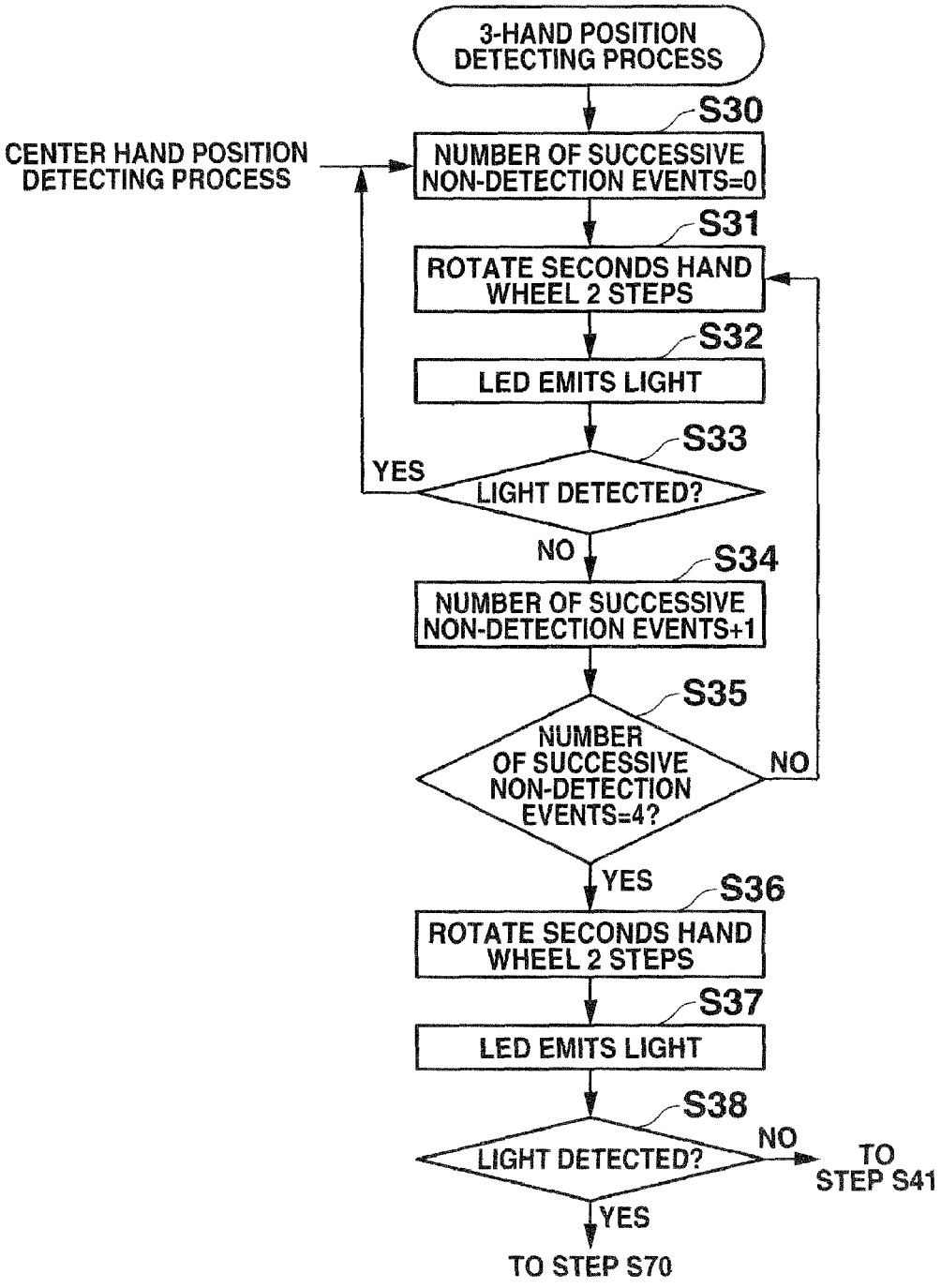
FIG. 19 is a flowchart indicative of a seconds hand position detection subprocess of a basic 3-hand position detecting process to move the seconds, center and hour hands to the detection position P.
Figure 20:
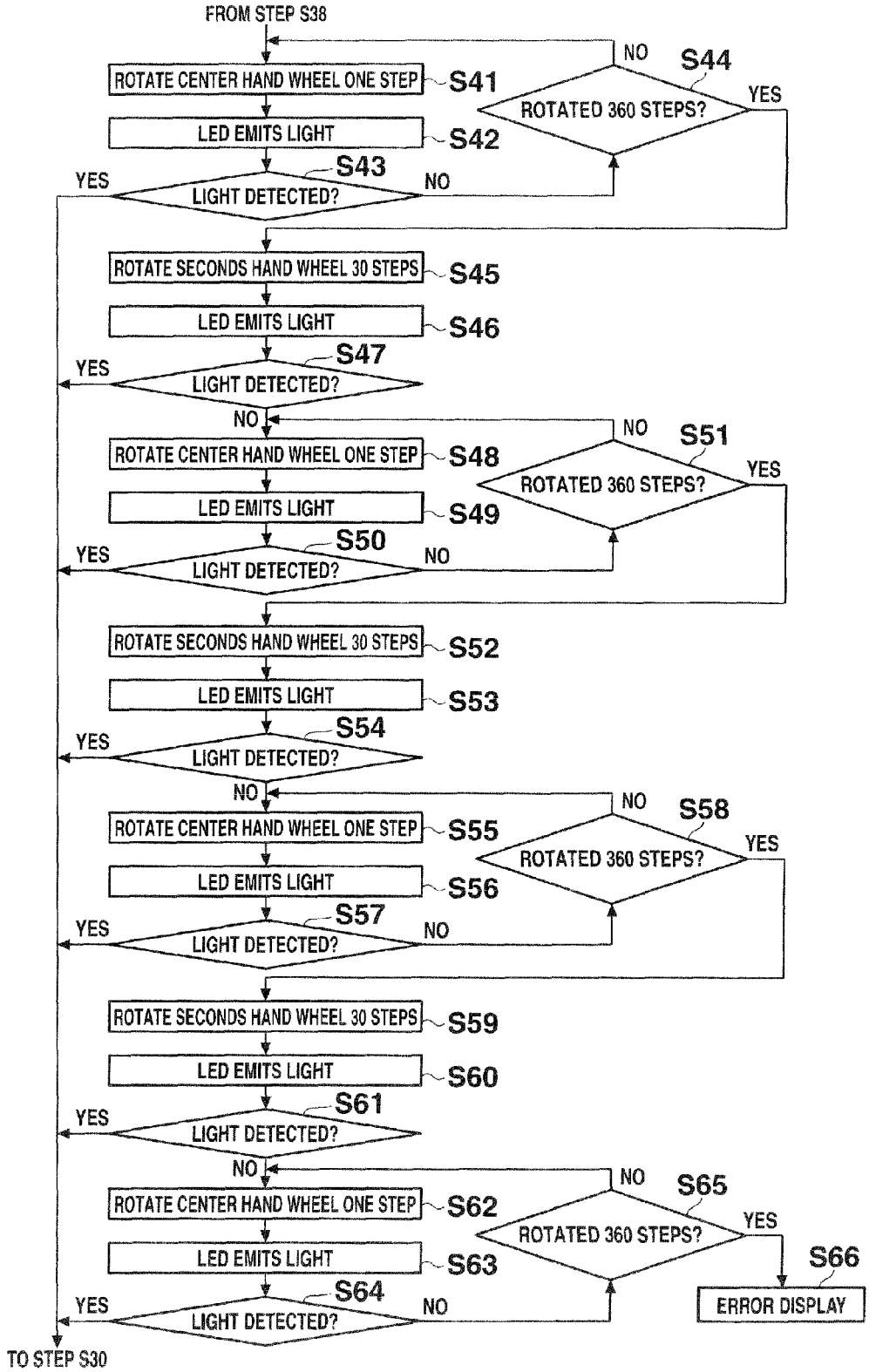
FIG. 20 illustrates a flowchart of a center hand position detecting subprocess of the basic 3-hand position detecting process.
Figure 21:
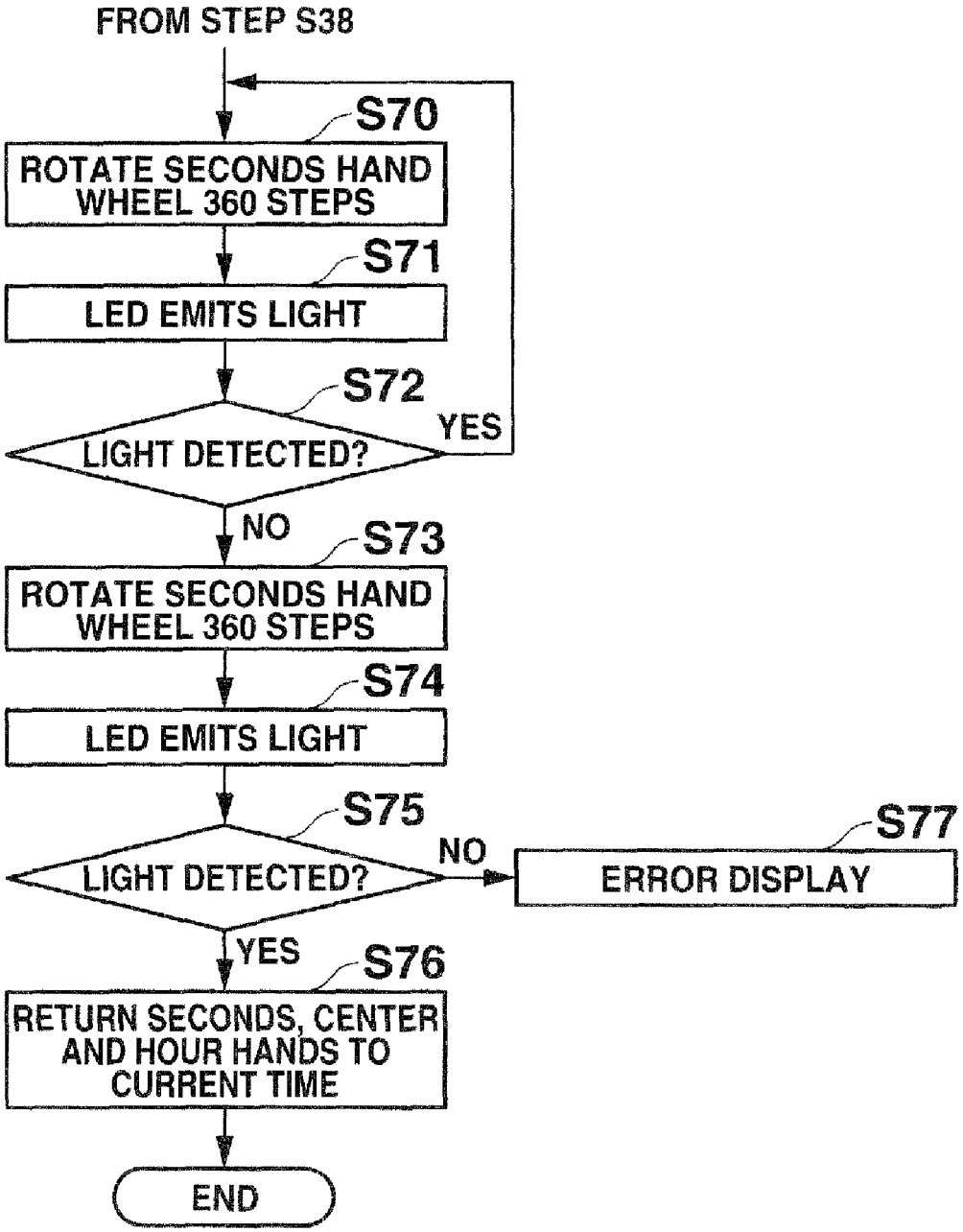
FIG. 21 illustrates a flowchart of an hour hand position detecting subprocess of the basic 3-hand position detecting process.

Referring to FIGS. 19 to 21, description will be made of a basic 3-hand position detecting process for detecting the reference positions of the seconds, center and hour hands 2, 3 and 4 of the wristwatch. In this case, assume that none of the positions of the seconds, center and hour hands 2, 3 and 4 is known. This process involves a combination of the seconds hand position detecting process and the center and hour hand position detecting process. FIG. 19 shows steps S30 to S38 of the seconds hand position detecting subprocess. FIG. 20 shows steps S41 to S66 of the center hand position detecting subprocess. FIG. 21 show steps S70 to S77 of the hour hand position detecting subprocess.

When this 3-hand position detecting process starts, the seconds hand position detecting process of FIG. 19 is performed because none of the positions of the seconds, center and hour hands 2, 3 and 4 is known. To this end, the number of non-detection events having occurred to the detection unit 13 so far is cleared, thereby resetting the non-detection flag bit to 0 (step S30). The seconds wheel 20 is rotated two steps (step S31). Then, the light emission element 31 is caused to emit light (step S32). Then, it is determined whether the photodetection element 32 has detected light from the light emission element 31 and hence whether the detection unit 13 has detected light (step S33).

At this time, none of the rotational positions of the seconds, center and hour wheels 20, 25 and 27 is known. When the photodetection element 32 has detected light from the photoemission element and the detection unit 13 has detected light, the control returns to the step S30 to repeat the steps S30 to S33 until one of the light blocking areas 21*d* to 21*f* of the seconds wheel 20 covers the detection position P.

When the detection unit 13 detects light in step S33, all the apertures 21, 28 and 30 in the seconds, center and intermediate wheels 20, 25 and 23 and a relevant one of the apertures 29 in the hour wheel 27 have aligned accidentally with the detection position P. At this time, the reference or 00-minute position in the center wheel 25 has aligned with the detection position P, but the reference positions in the seconds and hour wheels 20 and 27 are unknown. Thus, first, the reference position in the seconds wheel 20 is detected. To this end, the steps S30 to S33 are repeated until the light blocking area 21*e* of the seconds wheel 20 covers the detection unit P.

A non-detection event occurring to the detection unit 13 is counted by a counter (not shown) which may be included in the CPU 35 and the non-detection flag bit is set to 1 (step S34). Then, it is determined whether four non-detection events have occurred successively (step 35). Then, the steps S31 to S35 are repeated until in the step S35 four non-detection events occur successively to the detection unit 13. When four non-detection events occur successively to the detection unit 13, the seconds wheel 20 is rotated two steps (step S36), and the light emission element 31 is caused to emit light (step S37). Then, it is determined whether the photodetection element 32 has detected light from the light emission element 31, and hence whether the detection unit 13 has detected light (step S38).

If the detection unit 13 has detected light in step S38, it is determined that the reference position in the center wheels 25 has aligned with the detection position P, and that the aperture 28 in the center wheel 25, a relevant one of the apertures 29 in the hour wheel 27, and the aperture 21*a* in the seconds wheel 20 have aligned with the detection position P. Thus, it is determined that the respective reference positions in the seconds and center wheels 20 and 25 are at the 00-minute 00-second position. Then, the control passes to a hour hand position detecting process in a step S70.

When it is determined in the step S33 that the detection unit 13 detects no light, none of the rotational positions of the seconds, center and hour wheels 20, 25 and 27 is known. At this time, a non-detection event occurring to the detection unit 13 is counted by the counter and the non-detection flag bit is set to 1 (step S34). Then, it is determined whether four non-detection events have occurred successively (step 35). Then, the steps S31 to S35 are repeated until in the step S35 four nor-detection events occur successively.

When four non-detection events occur successively to the detection unit 13 in the step S35, the seconds wheel 20 is rotated two steps (step S36), and the light emission element 31 is caused to emit light (step S37). Then, it is determined whether the photodetection element 32 has detected light from the light emission element 31, and hence whether the detection unit 13 has detected light (step S38).

When the detection unit 13 detects light at this time, it will be known that the apertures 21*a*, 28 and 30 in the seconds, center and intermediate wheels 20, 25 and 23 and a relevant one of the apertures 29 in the hour wheel 27 have all aligned with the detection position P. Thus, it is determined as described above that the reference positions in the seconds and center wheels 20 and 25 are at the 00-minute 00-second position. Then the control passes to the step S70 to perform the hour hand position detecting process.

When in step S38 the detection unit 13 has detected no light, five non-detection events occur successively to the detection unit 13 even when the circular aperture 21*a* in the seconds wheel 20 has aligned with the detection position P, as shown in FIG. 14B. Thus, it is determined that one of the apertures 28 and 30 in the center and intermediate wheels 25 and 23 and a relevant one of the apertures 29 in the hour wheel 29 is offset from the detection position P. Then, the control passes to step S41 in FIG. 20 to perform the center hand position detecting process.

As shown in FIG. 20, in the center hand position detecting process, the center wheel 25 is rotated one step or degree in step S41; the light emission element 31 is caused to emit light (step S42); and then it is determined whether the photodetection element 32 has detected light from the light emission element 31, and hence whether the detection unit 13 has detected light (step S43). Otherwise, the center wheel 25 is rotated one step at a time, and then it is determined whether the seconds wheel 25 has rotated 360 degrees (step S44). Otherwise, the steps S41 to S43 are repeated until the center wheel 25 makes one rotation.

When the detection unit 13 has detected light in step S43, it will be known that the apertures 21, 28 and 30 in the seconds, center and intermediate wheels 20, 25 and 23 and a relevant one of the apertures 29 in the hour wheel 27 have all aligned wholly or partially with the detection position P. It will also be known that before the center wheel 25 starts to be rotated in the step S41, the apertures in the center and hour wheels 25 and 27 were offset from the detection position P. Since it is now assumed that the detection unit 13 has detected light in step S43, it is determined that the reference position in the center wheel 25 has aligned with the detection position P. Since also at this time it is not known whether the reference or 00-second position in the seconds wheel 20 has aligned with the detection position P, the control returns to the step S30, thereby performing the steps S30 to S38, which cause the reference position in the seconds wheel 20 to align with the detection position P. Then the control passes to the step S70 for the hour hand position detecting process.

When the detection unit 13 detects no light in the step S43 even when the center wheel 25 is rotated 360 degrees in the step S44, it is determined that the aperture 21 in the seconds wheel 20 has aligned neither wholly nor partially with the detection position P, as shown in FIG. 14D. Thus, the seconds wheel 20 is rotated 30 steps or 180 degrees (step S45) and the light emission element 31 is caused to emit light (step S46). Then, it is determined whether the photodetection element 32 has detected light and hence whether the detection unit 13 has detected light (step S47).

When at this time the detection unit 13 has detected light in the step S47, it will be known that the apertures 21 and 28 in the seconds and center wheels 20 and 25, a relevant one of the apertures 29 in the hour wheel 27 and the aperture 30 in the intermediate wheel 23 have aligned wholly or partially with the detection position P and that before the seconds wheel 20 started to be rotated in the step S52, the aperture 21 in the seconds wheel 20 were offset from the detection position P. Since at this time it is assumed that the detection unit 13 has detected light in the step S47, it is determined that the reference or 00-minute position in the center wheel 25 has aligned with the detection position P. However, it is still unknown at this time that the reference or 00-second position in the seconds wheel 20 has aligned with the detection position P. Thus, the control passes to the step S30 to perform the steps S30 to S38, thereby causing the reference position in the seconds wheel 20 to align with the detection position P and then to the step S70 for the hour hand position detecting process.

If the detection unit 13 detects no light in the step S47 even when the center wheel 25 is rotated 30 steps or 180 degrees in the step S45, then it is determined that the apertures 28 in the center wheel 25 is offset from the detection position P even when the aperture 21 in the seconds wheel 20 has aligned wholly or partially with the detection position P, as shown in FIG. 14E. Then, the center wheel 25 is rotated one step (step S48).

Then, the light emission element 31 is caused to emit light (step S49), it is determined whether the photodetection element 32 has detected light from the light emission element 31, and hence whether the detection unit 13 has detected light (step S50). Otherwise, the center wheel 25 is rotated one step at a time, and then it is determined whether the center wheel 25 has rotated 360 degrees (step S51). Otherwise, the steps S48 to S51 are repeated until the center wheel 25 makes one rotation.

When the detection unit 13 detects light in the step S50, it will be known that the apertures 21, 28 and 30 in the seconds, center and intermediate wheels 20, 25 and 23, and a relevant one of the apertures 29 in the hour wheel 29 have all aligned wholly or partially with the detection position P, and that before the center wheel 25 started to rotate in the step S50 the aperture in the center wheel 25 was offset from the detection position P. Since it is assumed that the detection unit 13 has now detected light in the step S50, it is determined that the reference or 00-minute position in the center wheel 25 has aligned with the detection position P. Since also at this time it is still unknown whether the reference or 00-second position in the seconds wheel has aligned with the detection position P, the control returns to the step S30, thereby performing the steps S30 to S38 for the seconds hand position detecting process to cause the reference position in the seconds wheel 20 to align with the detection position P. Then the control passes to the step S70 for the hour hand position detecting process.

If the detection unit 13 detects no light in the step S50 even when the center wheel 25 is rotated 360 degrees in the step S51, then it is determined that any of the apertures 29 in the hour wheel 27 is offset from the detection position P and that the light blocking area 29*a* in the hour wheel 27 covers the detection position P even when the aperture 21, 28 and 30 in the seconds, center and intermediate wheels 20, 25 and 23 align wholly or partially with the detection position P, as shown in FIG. 11P.

At this time, it is unknown that the aperture 21 in the second wheel 20 has aligned wholly or partially with the detection position P. Thus, the seconds wheel 20 is rotated 30 steps or 180 degrees (step S52), and the light emission element 31 is caused to emit light (step S53). Then it is determined whether the photodetection element 32 has detected light, and hence whether the detection unit 13 has detected light (step S54).

When the detection unit 13 has detected light at this time, it will be known that the apertures 21 and 28 in the seconds and center wheels 20 and 25, a relevant one of the apertures 29 in the hour wheel 27 and the aperture 30 in the intermediate wheel 23 have aligned wholly or partially with the detection position P; that the light blocking area 29*a* of the hour wheel 27 does not cover the detection position P; and that before the seconds wheel 20 started to be rotated in the step S52, the aperture 21 in the seconds wheel 20 was offset from the detection position P. Since it is now assumed that the detection unit 13 has detected light, it is determined that the reference or 00-minute position in the center wheel 25 has aligned with the detection position P. Since also at this time it is unknown whether the reference or 00-second position in the seconds wheel 20 has aligned with the detection position P, the control returns to the step S30, thereby performing the steps S30 to S38 for the seconds hand position detecting process to cause the reference position in the seconds wheel 20 to align with the detection position P. Then, the control passes to the step S70 for the hour hand position detecting process.

When the detection unit 13 does not detect light in the step S54, it is determined that the fourth light blocking are 29*a* of the hour wheel 27 has blocked the detection position P, as shown in FIG. 11P. Thus, the center wheel 25 is rotated one step (step S55), and the light emission element 31 is caused to emit light (step 56). Then, it is determined whether the photodetection element 32 has detected light from the light emission element 31, and hence whether the detection unit 13 has detected light (step S57). Otherwise, the center wheel 25 is rotated one step at a time, and it is determined whether the center wheel 25 has been rotated 360 degrees (step S58). Otherwise, then the steps S55 to S58 are repeated until the center wheel 25 makes one rotation.

When the detection unit 13 has detected light in the step S57, it is known that the aperture 21 in the seconds wheel 20, the aperture 28 in the center wheel 25, a relevant one of the apertures 29 in the hour wheel 27 and the aperture 30 in the intermediate wheel 23 have all aligned wholly or partially with the detection position P. It is also known that the light blocking area 29*a* of the hour wheel 27 has not blocked the detection position P and before the center wheel 25 started to be rotated in the step S55, the aperture 28 in the center wheel 25 was offset from the detection position P. Since it is now assumed that the detection unit 13 has detected light in the step S57, it is determined that the reference or 00-minute position in the center wheel 25 has aligned with the detection position P. Since also at this time it is unknown whether the reference or 00-second position in the seconds wheel 20 has aligned with the detection position P, the control returns to the step S30, thereby performing the steps S30 to S38 for the seconds hand position detecting process to cause the reference position in the seconds wheel 20 to align with the detection position P. Then, the control passes to the step S70 for the hour hand position detecting process.

If the detection unit 13 detects no light in the step S57 even when the center wheel 25 is rotated 360 degrees in step S58, it is conjectured that the light blocking area 29 of the hour wheel 27 has blocked the detection position P and hence that the hour wheel 27 is at the 11-o'clock position. In order to confirm whether this conjecture is correct, the seconds wheel 20 is rotated 30 steps or 180 degrees (step S59); the light emission element 31 is caused to emit light (step S60); and then it is determined whether the photodetection element 32 has detected light from the light emission element 31 and hence whether the detection unit 13 has detected light (step S61).

If at this time the detection unit 13 has detected light, the aperture 21 and 28 in the seconds and center wheels 20 and 25, a relevant one of apertures 29 in the hour wheel 27, and the aperture 30 in the intermediate wheel 23 have all aligned wholly or partially with the detection position P. Thus, it will be known that the hour wheel 27 is not at the 11-o'clock position and that before the seconds wheel 20 started to be rotated in the step S59 the aperture in the seconds wheel 20 was offset from the detection position P. Since it is now assumed that the detection unit 13 has detected light, it is determined that the reference or 00-minute position in the center wheel 25 has aligned with the detection position P.

Since also at this time it is unknown whether the reference or 00-second position in the seconds wheel 20 has aligned with the detection position P, the control returns to the step S30, thereby performing the steps S30 to S38 for the seconds hand position detecting process to cause the reference position in the seconds wheel 20 to align with the detection position P. Then, the control passes to the step S70 for the hour hand position detecting process.

When in the step S61 the detection unit 13 detects no light, it is determined that the light blocking area 29*a* of the hour wheel 27 has blocked the detection position P. Thus, the center wheel 25 is rotated one step (step S62). Then, the light emission element 31 is caused to emit light (step S63) and it is determined whether the photodetection element 32 has received light from the light emission element 31 and hence whether the detection unit 13 has detected light (step S64).

If at this time the detection unit 13 detects no light in the step S64, the center wheel 25 is rotated one step at a time and then it is determined whether the center wheel 25 has rotated 360 degrees (step S65). Otherwise, the steps S62 to S64 are repeated until the center wheel 25 rotates 360 degrees. If the detection unit 13 detects no light even when the steps S62 to S64 are repeated, an error is displayed (step S66). When in the step S64 the detection unit 13 detects light, it is determined that the reference or 0-o'clock and 00-minute positions in the hour and center wheels 27 and 25, respectively, have aligned with the detection position P.

Also in this case, it is unclear whether the reference 00-second position in the seconds wheel 20 has aligned with the detection position P. Thus, the control returns to the step S30 for the second hand position detecting process to perform the steps S30 to S38, thereby rotating the seconds wheel 20 so that its reference position aligns with the detection position P. Then, the control passes to a step S70 for the hour hand position detecting process shown in FIG. 21. In the step S70, the respective reference positions in the seconds and center wheels 20 and 25 are at the detection position P. Thus, as shown in FIG. 21, the center wheel 25 is rotated 360 degrees, thereby rotating the hour wheel 27 30 degrees. Then, the light emission element 31 is caused to emit light (step S71), and it is determined whether the photodetection element 32 has detected light from the light emission element 31 and hence whether the detection unit 13 has detected light (step S72).

At this time, when the detection unit 13 detects light each time the hour wheel 27 rotates 30 degrees, the respective apertures 29 in the hour wheel 27 sequentially align with the detection position P. Thus, the control returns to the step S70 to repeat the steps S70 to S72 until the light blocking area 29*a* at the 11-o'clock position in the hour wheel 27 covers the detection position P. Then, unless the detection unit 13 detect light, it is determined that the light blocking area 29*a* of the hour wheel 27 has blocked the detection position P and that the hour wheel 27 has aligned at the 11-o'clock position with the detection position P.

In order to confirm that this determination is correct, the center wheel 25 is again rotated 360 degrees, thereby rotating the hour wheel 27 30 degrees (step S73). Then, the light emission element 31 is caused to emit light (step S74). It is then determined whether the photodetection element 32 has detected light from the light emission element 31 and hence whether the detection unit 13 has detected light (step S75). If so, it is determined that the reference positions in all the seconds, center and hour wheels 20, 25 and 27 are at the 0-o'clock 00-minute and 00-second position which has aligned wholly or partially with the detection position P. Thus, the seconds, center and hour hands 2, 3 and 4 are set to the exact current time (step S76) and then switched over to the usual driving operation, thereby terminating this process. In step S75, if the detection unit 13 detects no light, an error is displayed (step S77).

Figure 22:
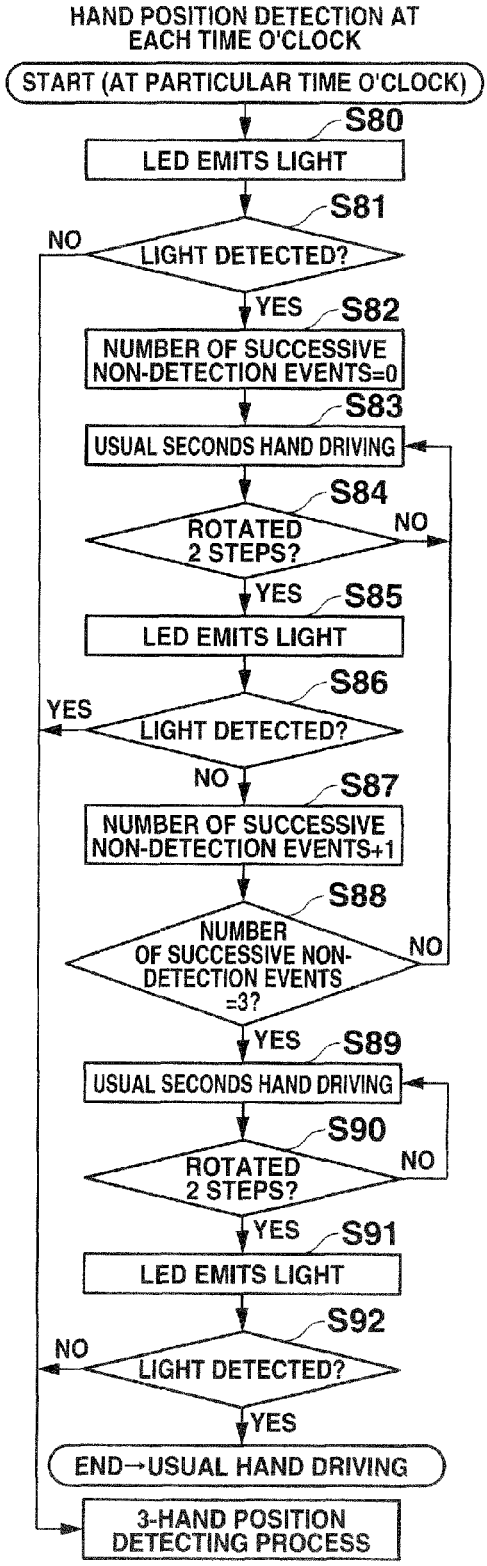
FIG. 22 is a flowchart indicative of a hand position confirming process for confirming the positions of the seconds, center and hour hands at every o'clock in the usual hand driving operation.

Then, referring to FIG. 22, description will be made of a hand position confirming process to confirm whether the seconds, center and hour hands 2, 3 and 4 are set correctly at a respective one of the time o'clock in the usual hand driving operation. In this process, the detection unit 13 tries to detect light at the respective one of those o'clock excluding the 11 and 23 o'clock. When the detection unit 13 detects light, the hour hand 4 is regarded as being set correctly. Then, it is confirmed whether the seconds hand 2 is set correctly. In this case, whether the seconds hand 2 is fast or slow can be confirmed only when the center wheel 3 is fast or slow by less than 60 minutes from the related time o'clock. When 10 seconds elapses from the related time o'clock, the center wheel 25 will be rotated one step and thus the intermediate wheel 23 rotates 30 degrees, thereby blocking the detection position P. Thus, it is necessary to confirm in 10 seconds from the related time o'clock whether the seconds hand 2 is fast or slow.

To this end, the hand position confirming process starts at each of time o'clock. Then, the light emission element 31 is caused to emit light (step S80). Then, it is determined whether the photodetection element 32 has detected light from the light emission element 31 and hence whether the detection unit 13 has detected light (step S81). Otherwise, it is determined that at least one of the seconds, center and hour hands 2, 3 and 4 is fast or slow and then the control passes to the three-hand position detecting process.

If the detection unit 13 detects light, it is determined that one of the apertures 21*a*, 21*b* and 21*c* in the seconds wheel 20 aligns wholly or partially with the detection position P. Then, the counted number of non-detection events having occurred to the detection unit 13 so far is cleared, thereby resetting the non-detection flag bit to zero (step S82). Then, the seconds wheel 20 rotates one step or 6 degrees in the usual manner, thereby causing the seconds hand 2 to sweep around in the usual manner (step S83). Then, it is determined whether the seconds wheel 20 has rotated two steps or 12 degrees (step S84). When the seconds wheel 20 rotates only one step or 6 degrees, the circular aperture 21*a* in the seconds wheel 20 does not completely move away from the detection position P. Thus, the detection 13 tries to detect light each time the seconds wheel 20 rotates two steps.

Unless in the step S84 the seconds wheel 20 has rotated two steps, the seconds hand 2 is caused to sweep around one step (or 6 degrees) at a time in the usual manner until the seconds wheel 20 has rotated two steps, whereupon the light emission element 31 is caused to emit light (step S85). Then, it is determined whether the photodetection element 32 has detected light from the light emission element 31 and hence whether the detection unit 13 has detected light (S86). When at this time the detection unit 13 detects light, any of the apertures 21*a*, 21*b* and 21*c* in the seconds wheel 20 has aligned wholly or partially with the detection position P. Hence it is determined that the seconds wheel 20 was not set exactly before the step S83 started and the control passes to the three-hand position detecting process.

When in the step S86 the detection unit 13 detects no light, it is determined that as shown in FIG. 15B, one of the blocking areas 21*d*-21*f* of the seconds wheel 20 has blocked the detection position P. Thus, this non-detection event is counted and the non-detection flag bit is set to 1 (step S87). Then, it is determined whether non-detection events have occurred three times successively (step S88). Otherwise, the control returns to step S83 to cause the seconds hand 2 to sweep around in the usual manner to repeat the steps S83 to S87.

If in step S88 three non-detection events have occurred successively when 6 seconds have elapsed from the related time o'clock, for example, from the state of FIG. 15B to that of FIG. 15D, it is determined that one of the light blocking areas 21*d* and 21*e* of the seconds wheel 20 has blocked the detection position P. Thus, the seconds wheel 20 is rotated one step or 6 degrees, thereby causing the seconds hand 2 to sweep around in the usual manner (step S89). It is then determined whether the seconds wheel 20 has rotated two steps (steps S90). Otherwise, the seconds hand 2 is caused to sweep around in the usual manner until the seconds wheel 20 rotates two steps.

When the seconds wheel 20 rotates two steps, the light emission element 31 is caused to emit light (step S91). Then, it is determined whether the photodetection element 32 has detected light from the light emission element 31 and hence whether the detection unit 13 has detected light when 8 seconds have elapsed from the related o'clock (step S92). Otherwise, it is determined that the light blocking area 21*e* of the seconds wheel 20 has blocked the detection position P and hence that the seconds wheel 20 is not set correctly. Thus, the control passes to the three-hand position detecting process. As shown in FIG. 15E, when in the step S92 the detection unit 13 detects light, the aperture 21*b* in the seconds wheel 20 has aligned partially with the detection position P. Thus, it is determined that the seconds wheel 20 is set correctly in time. Then, this process is terminated.

As described above, this hand type wristwatch comprises: the first driving system 11 in which the seconds wheel 20 rotates to drive the seconds hand 2; the second driving system 12 in which the center wheel 25 and hour wheel 27 drive the center hand 3 and the hour hand 4, respectively; the detection unit 13 which detects whether light has passed through apertures 21, 28 and 29 provided in the seconds, center and hour wheels, respectively, to determine the respective rotational positions of the seconds, center and hour wheels. The aperture 21 in the seconds wheel 20 comprises the circular aperture 21*a* provided at the predetermined position therein, and the first and second aperture 21*b*, 21*c* provided spaced by the first and second light blocking areas 21*d*, 21*e* of different distances in the driving and anti-driving directions of the seconds hand 2 from the center of the circular aperture 21*a*. Thus, the rotational position of the seconds wheel is detected accurately and securely.

According to this wristwatch, when the seconds wheel 20 rotates, the number of non-detection events which the detection unit 13 encounters differs between the first and second light blocking areas 21*d* and 21*e* present on the opposite sides of the aperture 21*a* in the seconds wheel 20. Thus, when the counted number of non-detection events which the detection unit 13 has encountered in the second light blocking area 21*e* has reached a predetermined number and then the detection unit 13 detects light or the aperture 21*a*, it may be determined that the seconds hand points to a time o'clock or 00-second position. Thus, the fifth wheel 18, which transmits rotation of the first stepping motor 17 to the seconds wheel 20, is not required to have light-passing apertures such as is required in the prior art, and the rotational position of the seconds wheel 20 is detected accurately and securely.

In this case, the arcuate apertures 21*b* and 21*c* in the seconds wheel 20 are disposed on the circumference of the same circle, or same locus of rotation, as the circular aperture 21*a* in the seconds wheel 20 with the center of the circle coinciding with that of the seconds wheel 20. A light blocking area 21*f* is provided between the arcuate apertures 21*b* and 21*c* so as to be on the diameter of the same circle as the circular aperture 21*a*. Although the apertures 21*b* and 21*c* are provided in the seconds wheel 20, the provision of the light blocking area 21*f* also ensures the strength of the seconds wheel 20 and considerable increases in the length of the arcuate apertures 21*b* and 21*c*. Thus, when the detection unit 13 detects light passing through one of the apertures 21*b* and 21*c* in the seconds wheel 20, the amount of light passing through these arcuate apertures 21*b* or 21*c* is increased. Thus, even when the seconds wheel 20 is rotated at high speeds, the rotational position of the seconds wheel 20 is detected accurately.

In this wristwatch, the center wheel 25 has the single aperture 28 provided at the reference or 00-minute position in the center wheel 25. The hour wheel 27 has the 11 apertures 29 provided at the angular intervals of 30 degrees along the periphery of the hour wheel 27, starting at its reference position, with the light blocking area 29*a* between the aperture at the reference position and the eleventh apertures. Thus, when the center wheel 25 is rotated one rotation, the aperture 28 in the center wheel 25 sequentially aligns with a respective one of the eleven apertures 29 in the hour wheel 27 except in the light blocking area 29*a*. Thus, each time the center wheel 25 is rotated one rotation, it can be determined easily whether the reference or 00-minute position in the center wheel 25 has aligned with the detection position P.

In this case, each time the center wheel 25 rotates one rotation, the hour wheel 27 rotates 30 degrees. Thus, the 11 circular apertures 29 in the hour wheel 27 sequentially align with the detection position P along with the aperture 28 in the center wheel 25. In addition, the position of the light blocking area 29*a* of the hour wheel 27 which covers the detection position P can be specified as 30 degrees before the reference or 00-hour position in the hour wheel 27; i.e., 11-hour position. In addition, when the center wheel 25 is rotated one more rotation from this state, thereby rotating the hour wheel 27 by 30 degrees, it can be determined that the reference or 0-hour position in the hour wheel 27 has aligned with the detection position P. Thus, such reference position is located as such easily.

The seconds driving system 12 includes the intermediate wheel 23 which transmits rotation of the second stepping motor 22 to the center wheel 25. The intermediate wheel 23 has the circular aperture 30 which can align with the aperture 28 in the center wheel 25. Thus, assume that the reference position in the center wheel 25 is detected by rotating the center wheel 25 only one step or degree. In this case, even when the aperture 28 in the center wheel 25 is not completely offset from the detection position P, as shown in FIG. 23, the intermediate wheel 23 rotates 30 degrees at one step, thereby covering the detection position P securely. Therefore, even when the detection unit 13 tries to detect light each time the center wheel 25 rotates one step, it is ensured that the detection unit 13 is prevented from wrongly detecting the center wheel 25.

In the seconds wheel 20 of the first driving system 11, the first light blocking area 21*d* extends through approximately 48 degrees in the driving direction of the seconds hand 2 from the center of the aperture 21*a* in the seconds wheel 20, or a net angular extent of appropriately 36 degrees which is approximately 3 times the angle of the first circular aperture 21*a*, as viewed from the center of the seconds wheel 20. Thus, when the seconds wheel 20 rotates 6 steps or 36 degrees by rotating one step or 6 degrees at a time such that the seconds hand 2 sweeps around normally, the first light blocking area 21*d* passes through the detection position P and in the next two steps the arcuate aperture 21*b* can align partially with the detection position P, thereby allowing the rotational position of the seconds wheel 20 to be confirmed in 8 seconds from the related time o'clock.

If it is confirmed after 10 seconds from the related time o'clock that the seconds hand 2 is set correctly in the normal driving operation, the center wheel 25 would rotate one degree, which would rotate the intermediate wheel 23 by 30 degrees and cause its aperture 30 move away from the detection position P. This would cause the intermediate wheel 23 to block or cover the detection position P. Thus, it is necessary to detect the position of the seconds hand 2 in 10 seconds from the related time o'clock. If the seconds hand 2 should be set correctly in less than 60 minutes from the related time o'clock, whether the seconds hand 2 is set correctly in the normal hand driving operation can be determined in 8 seconds from the related time o'clock. Thus, the position of the seconds hand 2 can be confirmed efficiently and rapidly.

The light blocking area 21*e* in the seconds wheel 20 extends through approximately 60 degrees along the periphery of the seconds wheel 20 in the anti-driving direction of the seconds hand 2 from the center of the circular aperture 21*a* in the seconds wheel 20, or through a net angular extent of 48 degrees which is approximately 4 times the angle of the circular aperture 21*a*, as viewed from the center of the seconds wheel 20, which is longer by approximately the angle of the aperture 21*a* than the light blocking area 21*d*. Thus, assume that the number of non-detection events the detection unit 13 encounters due to the light blocking area 21*e* covering the detection unit 13 is counted by rotating the seconds wheel 20 two steps or 12 degrees at a time. Then, when the detection unit 13 detects light through the aperture 21*a* after encountering four successive non-detection events, the position of the aperture 21*a* in the seconds wheel 20 is located as the reference or 00-second position in the seconds wheel 20. Thus, the position of the seconds hand 2 can be detected accurately and securely.

The first light locking area 21*d* is the same diameter of the seconds wheel 20 as part of the arcuate aperture 21*c*. The second light blocking area 21*e* is on the same diameter of the seconds wheel 20 as part of the arcuate aperture 21*b*. As described above, the third blocking area 21*f* is on the same diameter of the seconds wheel 20 as the circular aperture 21*a*. Thus, when the seconds wheel 20 rotates clockwise 30 degrees or 180 degrees from the state in which any one of the first-third light blocking areas 21*d* to 21*f* has blocked the detection position P in the detection unit 13, any of the circular and arcuate apertures 21*a*, 21*b* and 21*c* is necessarily arranged to align wholly or partially with the detection position P. Thus, when the respective rotational positions of the center and hour wheels 25 and 27 are detected, whether the seconds wheel 20 or both the center and hour wheels 25 and 27 are offset from the detection position P can be determined rapidly by rotating the seconds wheel half rotation. Thus, the time required for the position detection is greatly reduced.

Figure 24:
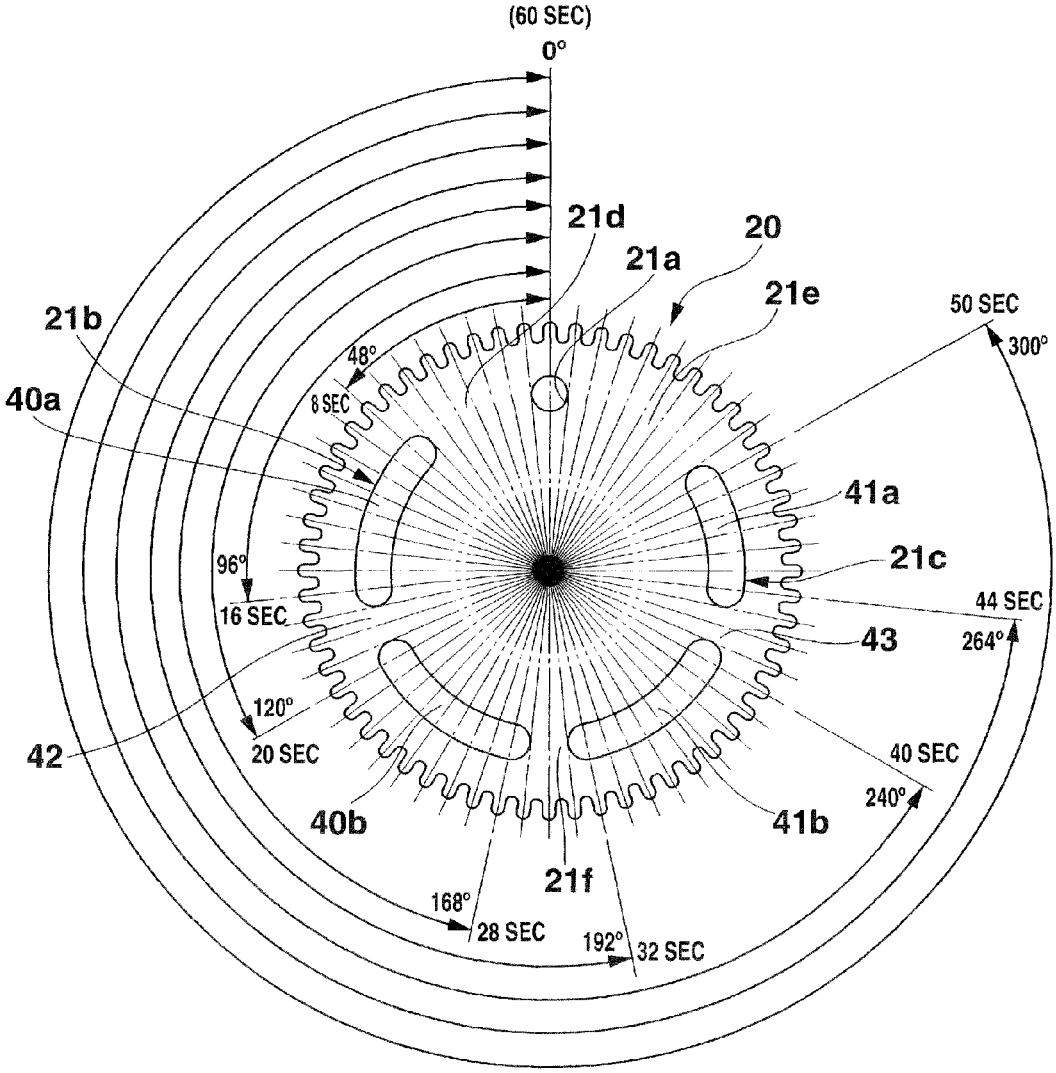
FIG. 24 is an enlarged plan view of a modification of the seconds wheel in this embodiment.

While in the embodiment the seconds wheel 20 is illustrated as having arcuate light-passing apertures 21*b* and 21*c*, it may be constructed as shown in a first modification in FIG. 24. More particularly, in the seconds wheel 20, the arcuate aperture 21*b* is divided into shorter arcuate apertures 40*a*, 40*b* and the arcuate aperture 21*c* into shorter arcuate apertures 41*a*, 41*b*.

In this case, the arcuate aperture 40*a* adjacent to the circular aperture 21*a* counterclockwise extends from approximately 48 degrees to approximately 96 degrees counterclockwise from the center of the circular aperture 21*a*, or through a net angular extent of approximately 60 degrees which is 5 times an angle of the circular aperture 21*a* as viewed from the center of the seconds wheel 20. The arcuate aperture 40*b* also extends from approximately 120 degrees to approximately 168 degrees counterclockwise from the center of the circular aperture 21*a*, or through a net angular extent of approximately 60 degrees which is 5 times the angle of the circular aperture 21*a* as viewed from the center of the seconds wheel 20. A fifth light blocking area 42 of the seconds wheel 20 is provided between the arcuate apertures 40*a* and 40*b* so as to be partially on the same diameter as the arcuate aperture 41*a*.

The arcuate aperture 41*a* adjacent to the circular aperture 21*a* extends from approximately 60 degrees to approximately 96 degrees clockwise from the center of the aperture 21*a*, or through a net angular extent of approximately 48 degrees which is 4 times an angle of the circular aperture 21*a* as viewed from the center of the seconds wheel 20. The arcuate aperture 41*b* extends from approximately 120 degrees to approximately 168 degrees clockwise from the center of the circular aperture 21*a* along the periphery of the seconds wheel 20, or through a net angular extent of approximately 60 degrees which is approximately 5 times the angle of the circular aperture 21*a* as viewed from the center of the seconds wheel 20. A sixth light blocking area 43 is provided between the arcuate apertures 41*a* and 41*b* in the seconds wheel 20 so as to be partially on the same diameter of the seconds wheel 20 as the arcuate aperture 40*a*.

A first light blocking area 21*d* is provided between the circular aperture 21*a* and the arcuate aperture 40*a*. A second light blocking area 21*e* is provided between the circular aperture 21*a* and the arcuate aperture 41*a*. A third light blocking area 21*f* is provided between the arcuate apertures 40*b* and 41*b* so as to be on the same diameter of the seconds wheel 20 as the circular aperture 21*a*.

Also in this case, the first light blocking area 21*d* is provided so as to extend through approximately 48 degrees from the center of the circular aperture 21*a*, or through a net angular extent of approximately 36 degrees which is approximately 3 times the angle of the circular aperture 21*a*, as viewed from the center of the seconds wheel 20. The first light blocking area 21*d* also is on the same diameter of the seconds wheel 20 as part of the arcuate aperture 41*b*. The second light blocking area 21*e* extends through approximately 60 degrees from the center of the circular aperture 21*a*, or through a net angular extent of approximately 48 degrees which is approximately 4 times the angle of the circular aperture 21*a*, as viewed from the center of the seconds wheel 20. The second light blocking area 21*e* also is on the same diameter of the seconds wheel 20 as the arcuate aperture 40*b*. Each of the light blocking areas 21*f*, 42 and 43 is substantially the same size as the circular aperture 21*a*. The light blocking area 21*f* is on the same diameter of the seconds wheel 20 the circular aperture 21*a*; the light blocking area 42 is on the same diameter of the seconds wheel 20 as part of the arcuate aperture 41*a*; and the light blocking area 43 is on the same diameter of the seconds wheel 20 as part of the arcuate aperture 40*a*.

The arrangement is such that when the seconds wheel 20 rotates 30 steps or 180 degrees from a state in which one of the light blocking areas 21*d*, 21*f*, 42 and 43 has covered the detection position P, a relevant one of the circular aperture 21*a* and the arcuate apertures 40*a*, 40*b*, 41*a* and 41*b* aligns wholly or partially with the detection position P. Thus, this modification produces similar advantages to those produced by the previous embodiment. In addition, the light blocking area 42 is provided between the arcuate apertures 40*a* and 40*b* and the light blocking area 43 between the arcuate apertures 41*a* and 41*b*. Thus, the mechanical strength of the seconds wheel 20 is improved compared to the previous embodiment.

In the above embodiment and the first modification of the seconds wheel 20, the first light blocking area 21*d* between the arcuate aperture 21*b* and the circular aperture 21*a* is illustrated as extending through approximately 48 degrees from the center of the circular aperture 21*a*, or through a net angular extent of approximately 36 degrees which is approximately 3 times the angle of the circular aperture 21*a* as viewed from the center of the seconds wheel 20. The second light blocking area 21*e* between the circular aperture 21*a* and the arcuate aperture 21*c* is illustrated as extending through approximately 60 degrees from the center of the circular aperture 21*a*, or through a net angular extent of approximately 48 degrees which is approximately 4 times the angle of the circular aperture 21*a*, as viewed from the center of the seconds wheel 20.

Alternatively, a second modification of the seconds wheel 20 as shown in FIG. 25 may be employed. In this modification, a first light blocking area 21*d* between the second arcuate aperture 21*b* and the circular aperture 21*a* extends through approximately 36 degrees counterclockwise from the center of the circular aperture 21*a*, or through a net angular extent of approximately 24 degrees which is approximately twice the angle of the circular aperture 21*a*. A second light blocking area 21*e* between the third arcuate aperture 21*c* and the circular aperture 21*a* extends through approximately 48 degrees clockwise from the center of the circular aperture 21*a*, or through a net angular extent of approximately 36 degrees which is approximately 3 times the angle of the circular aperture 21*a* as viewed from the center of the seconds wheel 20.

Like the first modification, the second modification has the arcuate aperture 21*b* which is divided into shorter arcuate apertures 40*a* and 40*b* with a fifth light blocking area 42 in between. The aperture 40*a* extends from approximately 36 degrees to approximately 96 degrees counterclockwise from the center of the circular aperture 21*a*, or longer toward to the circular aperture 21*a* by an net angular extent of the angle of the circular aperture 21*a* as viewed from the center of the seconds wheel 20 than the arcuate aperture 21*b* in the first modification.

Like the first modification, the second modification has the arcuate aperture 21*c* which is divided into shorter arcuate apertures 41*a* and 41*b* with a fourth light blocking area 43 in between. The aperture 41*a* extends from approximately 264 degrees to approximately 312 degrees clockwise from the center of the circular aperture 21*a*, or longer toward the circular aperture 21*a* by a net angular extent of the angle of the circular aperture 21*a* as viewed from the center of the seconds wheel 20 than the arcuate aperture 21*b* in the first modification.

Also in this case, the first light blocking area 21*d* between the arcuate aperture 21*b* and the circular hole 21*a* is on the same diameter of the seconds wheel 20 as part of the arcuate aperture 41*b*. The second light blocking area 21*e* between the arcuate aperture 21*c* and the circular hole 21*a* is on the same diameter of the seconds wheel 20 as the arcuate aperture 40*b*. In addition, the arcuate aperture 21*f* is on the same diameter of the seconds wheel 20 as the circular aperture 21*a*; the arcuate aperture 42 is on the same diameter of the seconds wheel 20 as the arcuate aperture 41*a*; and the arcuate aperture 43 is on the same diameter of the seconds wheel 20 as the circular aperture 41*a*.

This modification is fabricated such that when the seconds wheel 20 rotates 30 steps or 180 degrees, from the state in which one of the light blocking areas 21*d*, 21*f*, 42 and 43 has aligned wholly or partially with the detection position P of the detection unit 13, a relevant one of the circular aperture 21*a* and the arcuate apertures 40*a*, 40*b*, 41*a* and 41*b* aligns wholly or partially with the detection position P. Thus, this modification also produces advantages similar to those produced by the embodiment and first modification as well as the following additional advantages.

As described above, the first light blocking area 21*d* between the arcuate aperture 21*b* and the circular aperture 21*a* is provided so as to extend through approximately 36 degrees counterclockwise from the center of the circular aperture 21*a*, or through a net angular extent of approximately 24 degrees which is approximately twice the angle of the circular aperture 21*a*, as viewed from the center of the seconds wheel 20. Thus, assume that the seconds wheel 20 rotates one step or 6 degrees at a time and the seconds hand 2 sweeps around in the usual manner. In this case, when the seconds wheel 20 rotates four steps or 24 degrees, the first light blocking area 21*d* passes through the detection position P. When the seconds wheel 20 is rotated further two steps or 6 seconds, the arcuate aperture 40*a* aligns partially with the detection position P. Thus, the rotational position of the seconds wheel 20 can be confirmed in 6 seconds after the first light blocking area 21*d* has passed the detection position P. Therefore, when the seconds hand 2 should be set in less 60 minutes from the related time o'clock, it is confirmed more quickly in this modification than in the above-mentioned embodiment whether the seconds hand 2 is set correctly in the usual driving operation.

The light blocking area 21*e* between the arcuate aperture 21*c* and the circular aperture 21*a* is provided so as to extend through approximately 48 degrees clockwise from the center of the circular aperture 21*a*, or through a net angular extent of approximately 36 degrees which is approximately three times the angle of the circular aperture 21*a* as viewed from the center of the seconds wheel 20. Assume that the number of successive non-detection events the detection unit 13 has encountered due to the second blocking area 21*e* blocking the detection position P is counted by rotating the seconds wheel 20 two steps or 12 degrees at a time. When light passing through the circular aperture 21*a* is detected by the detection unit 13 after three successive non-detection events are counted, the position of that aperture in the seconds wheel 20 is determined as its reference or 00-second position. Thus, the reference position of the seconds hand 2 is detected more quickly than in the embodiment.

While in the embodiment and the modifications the apertures 21*a*, 28 and 29 provided in the seconds, center and hour wheels 20, 25 and 27 are illustrated as circular, they may be of another form such as square, trapezoidal or polygonal.

While in the above embodiment and modifications the hand-type wristwatches according to the present invention are illustrated, the invention is applicable to other hand-type timepieces such as travelers' clocks or watches, alarm clocks, table or desk clocks, wall clocks, etc.

Various modifications and changes may be made thereunto without departing from the broad spirit and scope of this invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

What is claimed is:

1. A hand position detecting device comprising:

a first driving system in which a first driving motor transmits its rotation to a seconds wheel, which in turn drives a seconds hand;

a second driving system in which a second driving motor transmits its rotation to a center wheel and an hour wheel, which in turn drive a center hand and an hour hand, respectively, wherein the seconds, center and hour wheels are rotatably attached on a same axis; and a detection unit, including light emission means, for detecting whether light emitted by the light emission means has passed through apertures provided in the seconds, center and hour wheels, respectively, to determine the respective rotational positions of the seconds, center and hour wheels when the seconds, center and hour wheels rotate;

wherein the aperture in the seconds wheel comprises a first circular aperture provided at a reference position in the seconds wheel, and a second aperture and a third aperture spaced by first and second light blocking areas of different distances, respectively, in the driving and anti-driving directions of the seconds hand from a center of the first circular aperture;

wherein the second and third apertures in the seconds wheel are arcuate and are provided substantially in opposed relationship on a same locus of rotation as the first circular aperture in the seconds wheel; and wherein the seconds wheel comprises a third light blocking area provided between the second and third apertures on a same diameter of the seconds wheel as the first circular aperture.

2. The hand position detecting device of claim 1, wherein the first light blocking area extends from approximately 36 degrees to approximately 48 degrees in the driving direction of the seconds wheel from the center of the first circular aperture along a periphery of the seconds wheel, and the second light blocking area extends from approximately 48 degrees to approximately 60 degrees in the anti-driving direction of the seconds wheel from the center of the first circular aperture along the periphery of the seconds wheel.

3. The hand position detecting device of claim 1, wherein the first light blocking area is on the same diameter of the seconds wheel as part of the third aperture, the second light blocking area is on the same diameter of the seconds wheel as part of the second aperture, and the third light blocking area is on the same diameter of the seconds wheel as the first circular aperture.

4. The hand position detecting device of claim 1, further comprising:

eleven o'clock position determining means for determining, as an eleven o'clock position in the hour wheel, a position of the light blocking area of the hour wheel which covers the aperture detecting means, thereby causing the aperture detecting means to detect no light.

5. An electronic apparatus comprising the hand position detecting device of claim 1.

6. A hand position detecting device comprising:

a first driving system in which a first driving motor transmits its rotation to a seconds wheel, which in turn drives a seconds hand;

a second driving system in which a second driving motor transmits its rotation to a center wheel and an hour wheel, which in turn drive a center hand and an hour hand, respectively, wherein the seconds, center and hour wheels are rotatably disposed on a same axis; and a detection unit, including light emitting means, for detecting whether light emitted by the light emitting means has passed through apertures provided in the seconds, center and hour wheels, respectively, to determine respective rotational positions of the seconds, center and hour wheels when the seconds, center and hour wheels rotate;

wherein the aperture in the center wheel is circular and is provided at a reference position in the center wheel, and the hour wheel comprises 11 circular apertures provided at angular intervals of 30 degrees along a periphery of the hour wheel, starting with a reference position provided in the hour wheel; and wherein the second driving system comprises an intermediate wheel which transmits the rotation of the second driving motor to the center wheel, and the intermediate wheel has an aperture which is alignable with the aperture in the center wheel.

* * * * *

UNITED STATES PATENT AND TRADEMARK OFFICE

CERTIFICATE OF CORRECTION

PATENT NO. : 8,023,362 B2
APPLICATION NO. : 12/238090
DATED : September 20, 2011
INVENTOR(S) : Suizu It is certified that error appears in the above-identified patent and that said Letters Patent is hereby corrected as shown below:

Title page

Item (12): Delete "Suizu et al." and insert -- Suizu --.

Item (75) Inventors: Delete inventor "Nobuhiro AOKI".

Signed and Sealed this
Fifth Day of April, 2016

Michelle K. Lee

Michelle K. Lee
*Director of the United States Patent and Trademark Office*